US011980276B2

(12) United States Patent
Kuga

(10) Patent No.: US 11,980,276 B2
(45) Date of Patent: May 14, 2024

(54) ROD-SHAPED OBJECT FEEDING CONTAINER

(71) Applicant: TOKIWA CORPORATION, Gifu (JP)

(72) Inventor: Wataru Kuga, Saitama (JP)

(73) Assignee: TOKIWA CORPORATION, Gifu (JP)

( * ) Notice: Subject to any disclaimer, the term of this patent is extended or adjusted under 35 U.S.C. 154(b) by 234 days.

(21) Appl. No.: 17/829,880

(22) Filed: Jun. 1, 2022

(65) Prior Publication Data

US 2022/0395078 A1 Dec. 15, 2022

(30) Foreign Application Priority Data

Jun. 15, 2021 (JP) ..... 2021-099478

(51) Int. Cl.
*A45D 40/20* (2006.01)
*A45D 40/06* (2006.01)

(52) U.S. Cl.
CPC ..... *A45D 40/205* (2013.01); *A45D 40/06* (2013.01); *A45D 2040/204* (2013.01); *A45D 2040/207* (2013.01); *A45D 2040/208* (2013.01)

(58) Field of Classification Search
CPC ..... A45D 40/205; A45D 2040/208; A45D 2040/204; A45D 2040/207; A45D 40/02; A45D 40/04; A45D 40/06; A45D 40/20
USPC ..... 401/68, 75, 171, 172, 174
See application file for complete search history.

(56) References Cited

U.S. PATENT DOCUMENTS 10,045,601 B2 * 8/2018 Endo ..... A45D 40/06
2019/0000216 A1 * 1/2019 Ohba ..... A45D 40/04

FOREIGN PATENT DOCUMENTS

JP 2020-103684 7/2020

* cited by examiner

*Primary Examiner* — David J Walczak
(74) *Attorney, Agent, or Firm* — Greenblum & Bernstein, P.L.C.

(57) ABSTRACT

A rod-shaped object feeding container includes a cartridge unit and a knock mechanism unit. The cartridge unit includes a movable body and a female screw member. The knock mechanism unit includes a coupling member, a knock member, a spring member, a main body tube, and a rotary member. When the knock member is pressed, the knock member converts a force with which the knock member is pressed into a rotational force and causes the coupling member and the female screw member to be rotated in one direction so as to advance the movable body and the rod-shaped object. When the rotary member is rotated relative to the main body tube in an opposite direction, the rotary member causes the coupling member and the female screw member to be rotated in the opposite direction so as to retract the movable body and the rod-shaped object.

6 Claims, 13 Drawing Sheets

ROD-SHAPED OBJECT FEEDING CONTAINER

CROSS-REFERENCE TO RELATED APPLICATIONS

This application claims the benefit of priority from Japanese patent Application No. 2021-099478, filed on Jun. 15, 2021, the entire contents of which are incorporated herein by reference.

BACKGROUND

The present disclosure relates to a knock type rod-shaped object feeding container that feeds a rod-shaped object by a knock.

Various rod-shaped object feeding containers that feed a rod-shaped object by a knock have been known. Japanese Patent Laid-Open No. 2020-103684 discloses a feeding container that feeds a rod-shaped content held in a holding tube. The feeding container includes an exterior tube, a helical tube disposed in the exterior tube, a housing tube inserted into the helical tube, and the above-described holding tube. The inside of the exterior tube is provided with a rotary member, a knock member, an interposition ring, a biasing member, a ring member, a cap, a knock mechanism, and a lock mechanism.

In this feeding container, when the cap is removed and the knock member is pushed in upward (or a knock operation is performed), the knock member pushes up the rotary member. Then, the helical tube, the interposition ring, the holding tube, and the rod-shaped content together with the rotary member are moved upward with respect to the housing tube and the exterior tube. At this time, the rotary member is rotated to one side in a circumferential direction with respect to the knock member and the exterior tube. Thereafter, the rod-shaped content projects upward with respect to the exterior tube, and is thus set in a usable state.

SUMMARY

In the above-described feeding container, the rod-shaped content is fed by the knock operation of pushing in the knock member upward. In the case of this knock type feeding container, the entire feeding container may be discarded after the rod-shaped content is used up. A smaller number of discarded parts is desirable from a viewpoint of ecology. The number of discarded parts is desired to be reduced also in the knock type rod-shaped object feeding container.

It is an object of the present disclosure to provide a knock type rod-shaped object feeding container that can reduce the number of discarded parts.

A rod-shaped object feeding container according to the present disclosure includes a cartridge unit having a rod-shaped object and a knock mechanism unit which the cartridge unit is attachable to and detachable from and which advances and retracts the rod-shaped object. The cartridge unit includes a movable body and a tubular female screw member. The movable body has a gripping portion configured to grip the rod-shaped object and has a male screw at an outer peripheral portion thereof. The tubular female screw member has a female screw configured to be screwed to the male screw. The knock mechanism unit includes a coupling member, a knock member, a spring member, a main body tube, and a rotary member. The coupling member is configured to be coupled to the cartridge unit and is synchronously rotatable with the female screw member when coupled to the cartridge unit. The knock member is capable of being pressed to advance the rod-shaped object. The spring member is configured to bias the coupling member and the knock member rearward. The main body tube houses the coupling member and the spring member. The rotary member is disposed on a rear side of the main body tube, houses the knock member, and is rotatable relative to the main body tube. When the knock member is pressed, the knock member converts a force with which the knock member is pressed into a rotational force and causes the coupling member and the female screw member to be rotated relative to the movable body in one direction, so as to advance the movable body and the rod-shaped object. When pressing of the knock member is released and the rotary member is rotated relative to the main body tube in an opposite direction from the one direction, the rotary member causes the coupling member and the female screw member to be rotated relative to the movable body in the opposite direction, so as to retract the movable body and the rod-shaped object.

The rod-shaped object feeding container includes the cartridge unit having the rod-shaped object and the knock mechanism unit attachable to and detachable from the cartridge unit. Therefore, after the rod-shaped object is used up, it suffices to detach (or remove) the cartridge unit from the knock mechanism unit, and discard only the cartridge unit. Hence, it is not necessary to discard the entire rod-shaped object feeding container, and it suffices to attach (or fit) a new cartridge unit to the existing knock mechanism unit at a time of replacement of the cartridge unit. The number of discarded parts can therefore be reduced. The knock mechanism unit includes the coupling member synchronously rotatable with the female screw member of the cartridge unit, the knock member advancing the rod-shaped object, and the rotary member housing the knock member. When the knock member is pressed, the knock member converts a force with which the knock member is pressed into a rotational force, and causes the coupling member and the female screw member to be rotated relative to the movable body in the one direction, so as to advance the movable body and the rod-shaped object. Therefore, because the pressing of the knock member can advance the rod-shaped object to be fed, the usability of the rod-shaped object feeding container can be improved. That is, a highly usable rod-shaped object feeding container can be provided because the rod-shaped object can be fed by holding the rod-shaped object feeding container with one hand and pressing the knock member with one hand. In addition, when the pressing to the knock member is released and the rotary member is rotated relative to the main body tube in the opposite direction from the above-described one direction, the rotary member causes the coupling member and the female screw member to be rotated relative to the movable body in the opposite direction, so as to retract the movable body and the rod-shaped object. The rod-shaped object can therefore be retracted by the relative rotation of the rotary member with respect to the main body tube. Thus, the rod-shaped object feeding container allows the rod-shaped object to be fed by a knock and allows the rod-shaped object to be returned by the rotation of the rotary member.

The cartridge unit may include a tubular member located on a rear side of the female screw member. The tubular member is synchronously rotatable with the female screw member and is configured to be coupled with the coupling member. The tubular member may have a first rib formed on an inner surface thereof. The first rib extends along an axial direction in which an axis of the tubular member extends.

The coupling member may have a second rib formed on an external surface thereof. The second rib is configured to engage with the first rib in a rotational direction. In this case, the female screw member of the cartridge unit and the coupling member of the knock mechanism unit can be coupled to each other via the tubular member, and the female screw member, the tubular member, and the coupling member can be made synchronously rotatable.

The knock mechanism unit may include a tubular ratchet member that is disposed in the main body tube and houses the coupling member. The coupling member may have a third rib formed on an external surface thereof. The third rib extends along an axial direction in which an axis of the ratchet member extends. The ratchet member may have a fourth rib formed on an inner surface thereof. The fourth rib is configured to engage with the third rib in a rotational direction when the coupling member and the female screw member are rotated relative to the movable body in the opposite direction. In this case, the ratchet member can be synchronously rotated in the opposite direction together with the coupling member and the female screw member.

According to the present disclosure, the number of discarded parts can be reduced.

DETAILED DESCRIPTION

Figure 1A:
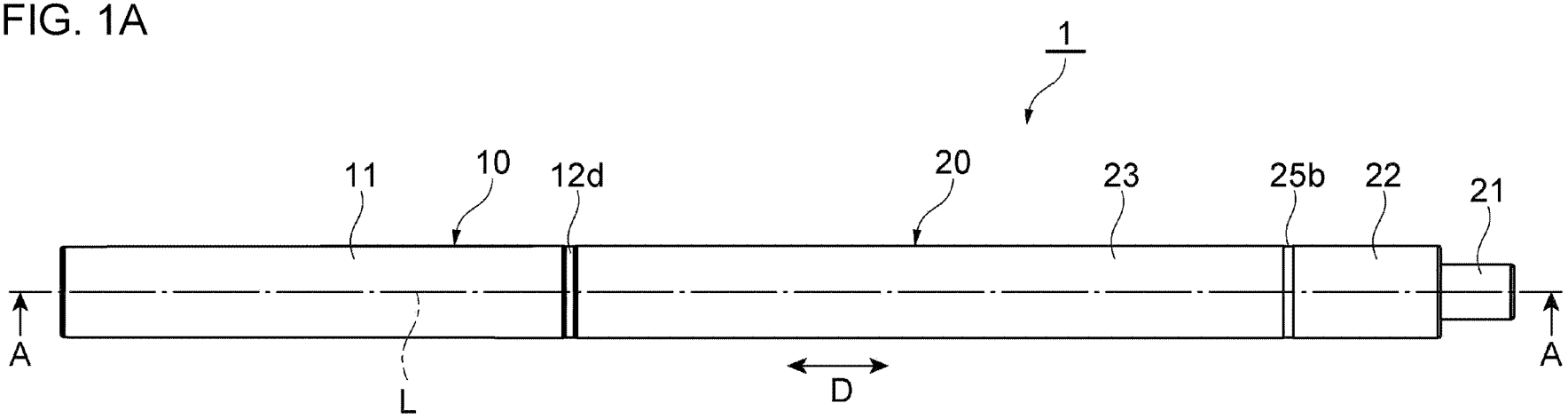
FIG. 1A is a side view illustrating a rod-shaped object feeding container according to an embodiment.

A rod-shaped object feeding container according to an embodiment of the present disclosure will be described below with reference to the drawings. In the description of the drawings, the same or equivalent elements are denoted by the same reference symbols, and overlapping description is omitted as required. In addition, in order to facilitate understanding, the drawings may be depicted in a partly simplified or exaggerated manner, and dimensional ratios and the like are not limited to those provided in the drawings.

In the present disclosure, a "rod-shaped object" represents a rod-shaped object to be applied to an application portion as an application target. The "rod-shaped object" may, for example, be a rod-shaped cosmetic material or a rod-shaped drawing material. In the present embodiment, description will be made of an example in which the rod-shaped object is a rod-shaped cosmetic material. The "cosmetic material" is, for example, a lipstick, a lipliner, a lip gloss, an eyeliner, an eyebrow pencil, a cosmetic stick, or a concealer. The "cosmetic material" may be a rod-shaped object including a flexible material (such as a rod-shaped object in a semisolid state, a soft solid state, a soft state, a jelly state, a mousse state, or paste containing these).

Figure 1B:
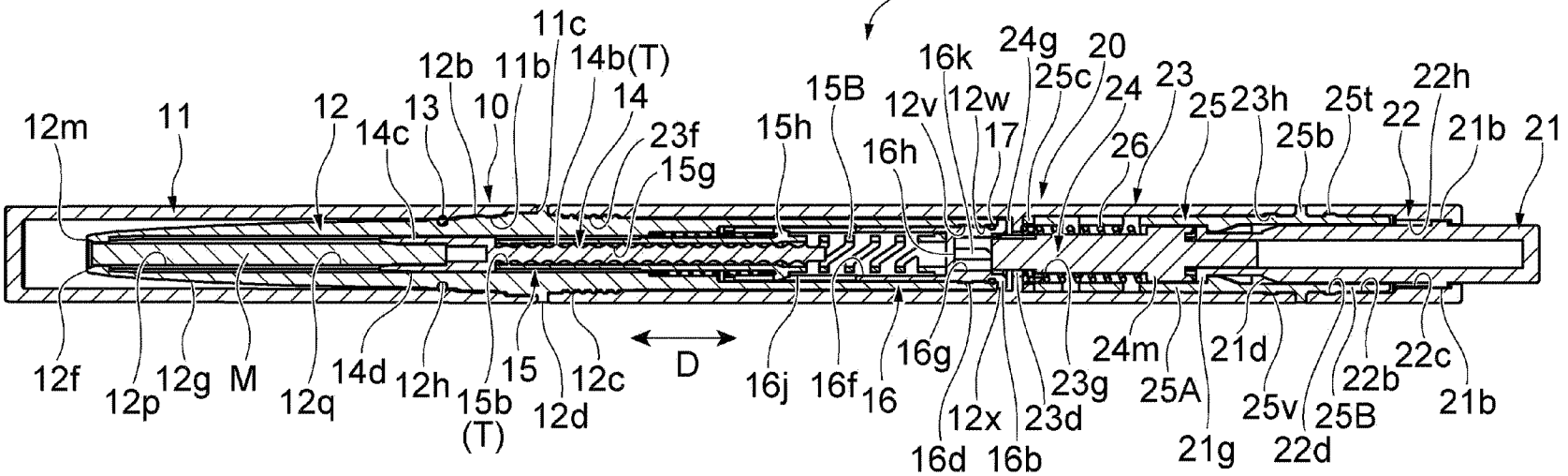
FIG. 1B is a sectional view taken along line A-A of FIG. 1A.

FIG. 1A is a side view of a rod-shaped object feeding container 1 according to an embodiment. FIG. 1B is a sectional view taken along line A-A of FIG. 1A. As illustrated in FIG. 1A and FIG. 1B, the rod-shaped object feeding container 1 is, for example, a rod-shaped cosmetic material feeding container that feeds (pushes out) a rod-shaped cosmetic material M housed in the rod-shaped object feeding container 1 in response to a knock operation by a user. The rod-shaped cosmetic material M is, as an example, a volatile rod-shaped cosmetic material.

The rod-shaped object feeding container 1 has a circular stick shape. The rod-shaped object feeding container 1 extends along an axial direction D. The axial direction D is a direction in which an axis L of the rod-shaped object feeding container 1 extends. The rod-shaped object feeding container 1 includes a cartridge unit 10 having the rod-shaped cosmetic material M, and a knock mechanism unit 20 which the cartridge unit 10 is attachable to and detachable from. The cartridge unit 10 can be, for example, detached (or removed) from the knock mechanism unit 20 after the rod-shaped cosmetic material M is used up. In addition, a new cartridge unit 10 can be attached (or fitted) to the knock mechanism unit 20.

In the present disclosure, description will be made supposing that a direction in which the cartridge unit 10 is provided as viewed from the knock mechanism unit 20 and a direction in which the rod-shaped cosmetic material M is fed are "front," "front side," or "forward," and that a direction in which the knock mechanism unit 20 is provided as viewed from the cartridge unit 10 and a direction in which the rod-shaped cosmetic material M is returned are "rear," "rear side," or "rearward."

Figure 2A:
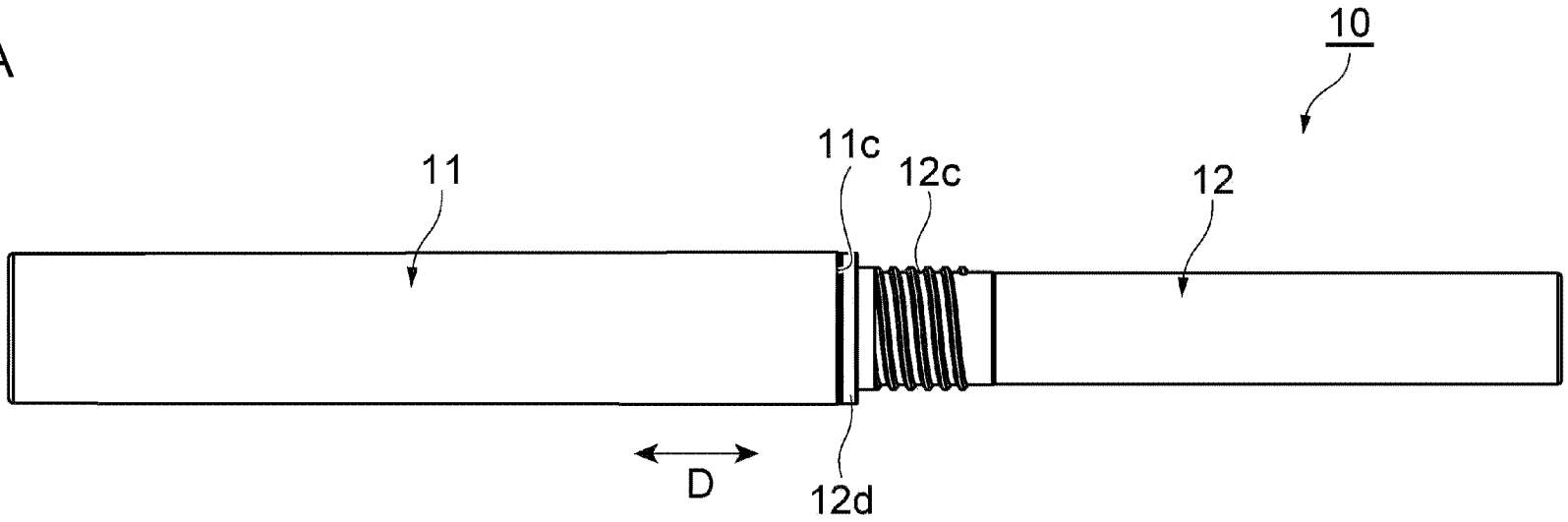
FIG. 2A is a side view illustrating a cartridge unit according to the embodiment.
Figure 2B:
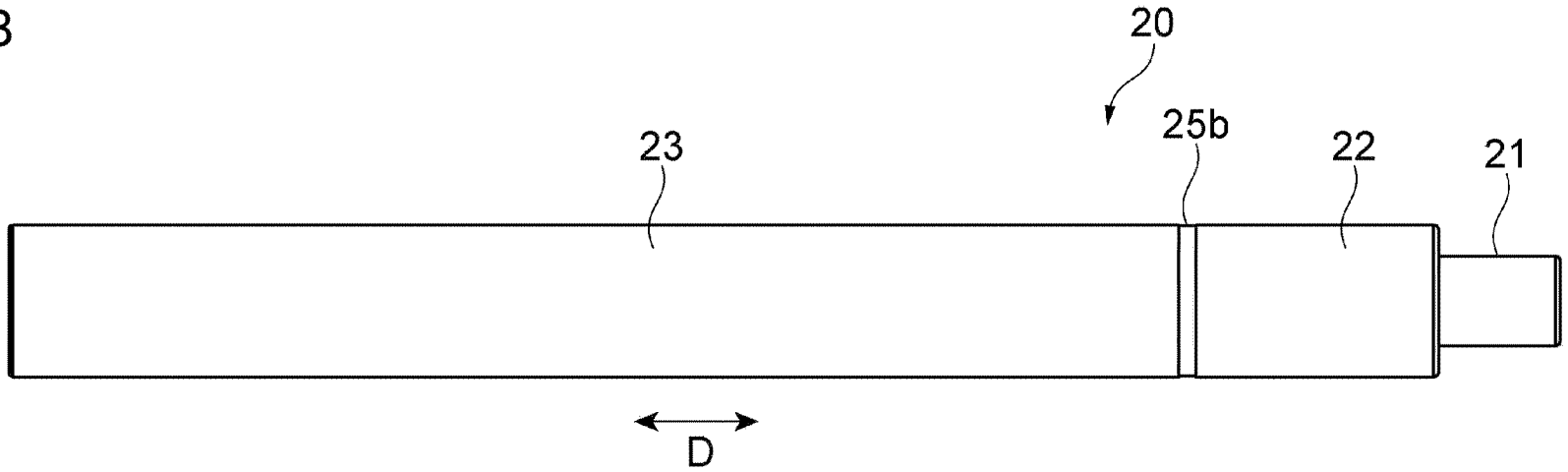
FIG. 2B is a side view illustrating a knock mechanism unit according to the embodiment.

FIG. 2A is a side view illustrating the cartridge unit 10. FIG. 2B is a side view illustrating the knock mechanism unit 20. As illustrated in FIG. 1B, FIG. 2A, and FIG. 2B, the knock mechanism unit 20 includes a knock member 21 for feeding the rod-shaped cosmetic material M, a rotary member 22 that houses a part of the knock member 21, and a main body tube 23 coupled to the rotary member 22 in a relatively rotatable manner. The rotary member 22 and the main body tube 23 each have a cylindrical shape. The rotary member 22 is disposed on the rear side of the main body tube 23. The knock member 21 projects rearward from the rotary member 22.

The cartridge unit 10 according to the present embodiment will first be described. The cartridge unit 10 includes a cap 11 and a leading tube 12 to which the cap 11 is attached. Provided in the cartridge unit 10 are a movable body 14 which moves along the axial direction D and has a male screw 14*b*, a tubular female screw member 15 that has a female screw 15*b* to be screwed to the male screw 14*b*, and a tubular member 16 located on the rear side of the female screw member 15.

The cap 11 has a bottomed tubular shape. The cap 11 has an annular protruding portion 11*b* on an inner surface thereof. The leading tube 12 has, on an external surface, a protruding portion 12*b* with which the annular protruding portion 11*b* engages in the axial direction D. The leading tube 12 projects rearward from the cap 11 in a state in which the protruding portion 12*b* engages with the annular protruding portion 11*b* of the cap 11 in the axial direction D. The leading tube 12 has a male screw portion 12*c*. The cartridge unit 10 is attached to the knock mechanism unit 20 by screwing the male screw portion 12*c* into the knock mechanism unit 20. A structure for attaching the cartridge unit 10 to the knock mechanism unit 20 is not limited to the above-described screwing. For example, in place of the above-described screwing, a structure may be adopted in which a protrusion is provided to the inner surface of each of the cartridge unit 10 and the knock mechanism unit 20, and the protrusion of the cartridge unit 10 is engaged with the protrusion of the knock mechanism unit 20.

Figure 3A:
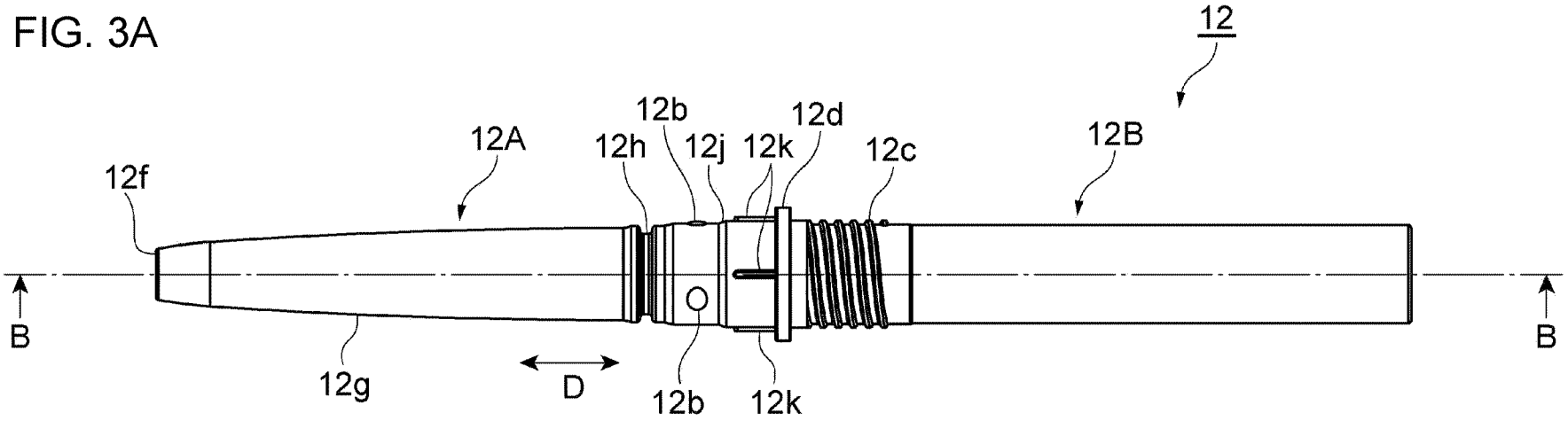
FIG. 3A is a side view illustrating a leading tube of the rod-shaped object feeding container according to the embodiment.
Figure 3B:
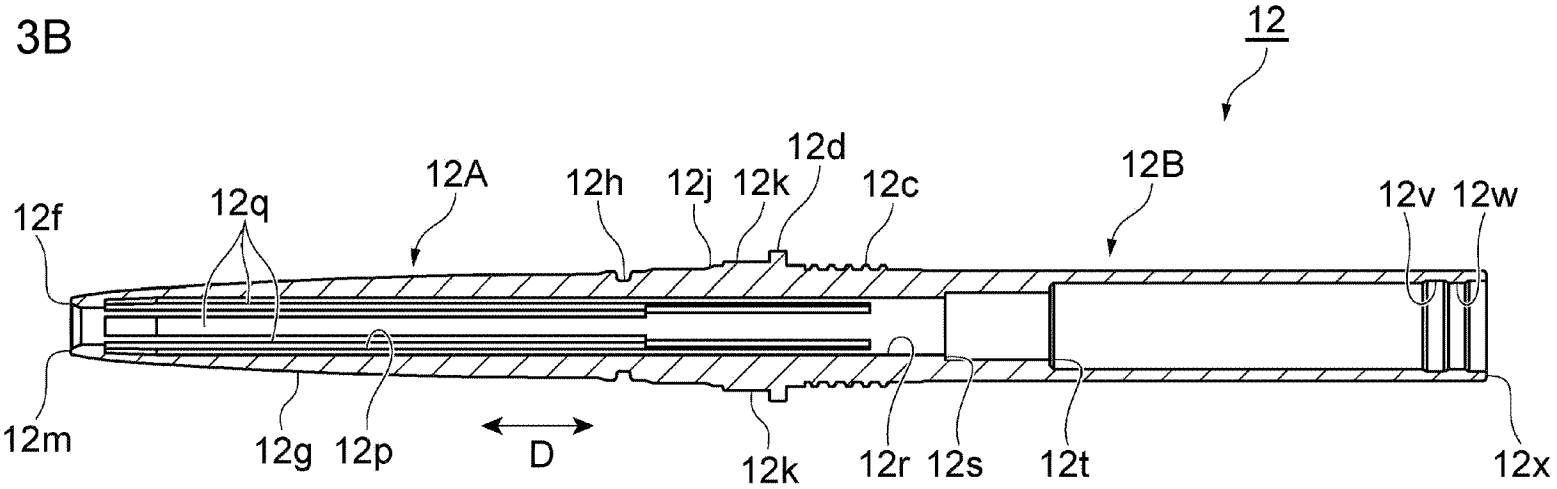
FIG. 3B is a sectional view taken along line B-B of FIG. 3A.

FIG. 3A is a side view illustrating the leading tube 12. FIG. 3B is a sectional view taken along line B-B of FIG. 3A. As illustrated in FIG. 1B, FIG. 3A, and FIG. 3B, the leading tube 12 includes a front side tubular portion 12A, a rear side tubular portion 12B located on the rear side of the front side tubular portion 12A, and a flange portion 12*d* located between the front side tubular portion 12A and the rear side tubular portion 12B. The rear side tubular portion 12B is a tubular part extending rearward from the flange portion 12*d*. The rear side tubular portion 12B has a cylindrical shape. The above-described male screw portion 12*c* that is screwed onto the inner surface of the main body tube 23 is formed on an outer peripheral portion of the rear side tubular portion 12B. The male screw portion 12*c* is provided on the rear side of the flange portion 12*d*.

The flange portion 12*d* is provided between the cap 11 and the main body tube 23, and is exposed to the outside of the rod-shaped object feeding container 1. The front side tubular portion 12A includes a tapered surface 12*g* reduced in diameter toward a front end 12*f* of the leading tube 12, an annular recessed portion 12*h* located on the rear side of the tapered surface 12*g*, an inclined surface 12*j* located in the rear of the annular recessed portion 12*h*, and protruding portions 12*k* extending from the flange portion 12*d* toward the inclined surface 12*j*.

An opening 12*m* from which the rod-shaped cosmetic material M is exposed is formed at the front end 12*f* of the leading tube 12. An internal space 12*p* of the leading tube 12 that houses the rod-shaped cosmetic material M is formed on the rear side of the opening 12*m*. The outside diameter of the leading tube 12 along the tapered surface 12*g* is increased from the front end 12*f* toward the rear.

The annular recessed portion 12*h* is provided to hold an O-ring 13. The O-ring 13 is inserted into the annular recessed portion 12*h*. The O-ring 13 inserted in the annular recessed portion 12*h* is in close contact with the inner surface of the cap 11. Airtightness on the front side of the O-ring 13 (front end 12*f* side) is thereby ensured in a state in which the cap 11 is attached.

The above-described protruding portion 12*b* is formed between the annular recessed portion 12*h* and the inclined surface 12*j*. The leading tube 12, for example, has a plurality of protruding portions 12*b* arranged along the circumferential direction of the leading tube 12. Each of the plurality of protruding portions 12*b* engages with the annular protruding portion 11*b* of the cap 11 in the axial direction D. The protruding portions 12*b* each have a circular shape.

The outside diameter of the leading tube 12 along the inclined surface 12*j* is increased toward the rear. The protruding portions 12*k* extending in the axial direction D are provided in the rear of the inclined surface 12*j*. The leading tube 12 has a plurality of protruding portions 12*k*. The plurality of protruding portions 12*k* are arranged along the circumferential direction of the leading tube 12. The protruding portions 12*k* engage with the inner surface of the cap 11. The cap 11 is attached to the leading tube 12 in a state in which an end surface 11*c* forming an opening of the cap 11 faces the flange portion 12*d* along the axial direction D.

The internal space 12*p* of the leading tube 12 extends rearward from the opening 12*m*. The internal space 12*p* penetrates the leading tube 12 in the axial direction D. The internal space 12*p* houses the movable body 14, the female screw member 15, and the tubular member 16. The movable body 14, the female screw member 15, and the tubular member 16 are arranged so as to be lined in this order.

The internal space 12*p* is provided with a ridge 12*q* extending along the axial direction D. The leading tube 12, for example, has a plurality of ridges 12*q*. The ridges 12*q* are provided to prevent rotation of the movable body 14. That is, the ridges 12*q* engage with the movable body 14 in a rotational direction (circumferential direction). The movable body 14 thereby engages with the leading tube 12 in a non-rotatable manner.

Provided in the rear of the ridges 12*q* in the internal space 12*p* are a first step portion 12*s* increased in diameter from an inner surface 12*r* on which the ridges 12*q* are formed, and a second step portion 12*t* increased in diameter in the rear of the first step portion 12*s*. The first step portion 12*s* is located closer to the front side of the leading tube 12 than the second step portion 12*t*. The inside diameter of the leading tube 12 on the rear side of the first step portion 12*s* is larger than the inside diameter of the leading tube 12 on the front side of the first step portion 12*s*. The inside diameter of the leading tube 12 on the rear side of the second step portion 12*t* is larger than the inside diameter of the leading tube 12 on the front side of the second step portion 12*t*.

An annular recessed portion 12*v* and an annular protruding portion 12*w* with which the tubular member 16 engages in the axial direction D are formed in the internal space 12*p*.

The annular recessed portion 12*v* and the annular protruding portion 12*w* are located in the rear of the second step portion 12*t*. The annular recessed portion 12*v* is provided on the front side of the annular protruding portion 12*w*. The tubular member 16 going over the annular protruding portion 12*w* is fitted into the annular recessed portion 12*v*, so that the tubular member 16 is engaged with the leading tube 12 in the axial direction D.

Figure 4:
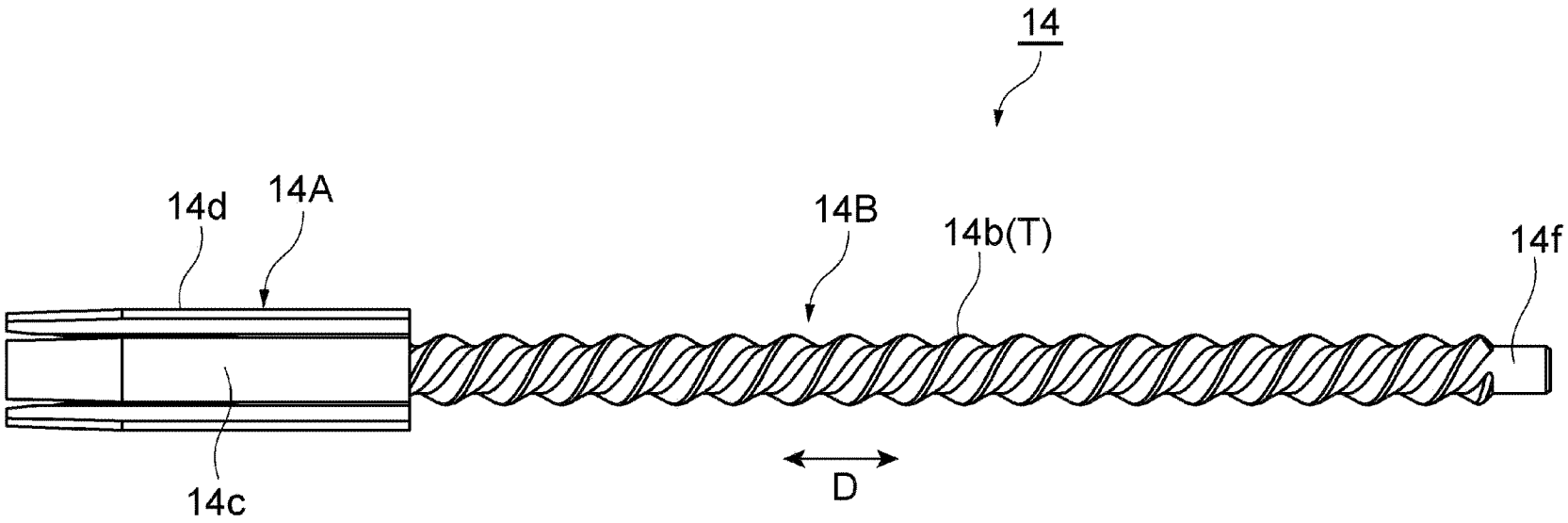
FIG. 4 is a side view illustrating a movable body according to the embodiment.

FIG. 4 is a side view illustrating the movable body 14. As illustrated in FIG. 1B and FIG. 4, the movable body 14 includes a holding portion 14A holding the rod-shaped cosmetic material M, and a rod-shaped portion 14B that extends in the axial direction D from the holding portion 14A and that has the above-described male screw 14*b* formed on the outer peripheral portion thereof. The holding portion 14A is located on the front side of the rod-shaped portion 14B.

The holding portion 14A includes a tubular gripping portion 14*c* that grips the rod-shaped cosmetic material M, and an engaging portion 14*d* that is located radially outward of the gripping portion 14*c* and that engages with the ridges 12*q* of the leading tube 12 in the rotational direction. The engaging portion 14*d* is engaged with the ridges 12*q* in the rotational direction, so that the movable body 14 is engaged with the leading tube 12 in non-rotatable manner.

The rod-shaped portion 14B extends rearward from the holding portion 14A. The rod-shaped portion 14B includes the male screw 14*b* and a curved surface portion 14*f* located on the rear side of the male screw 14*b*. The curved surface portion 14*f* corresponds to a part on which the male screw 14*b* is not formed. The curved surface portion 14*f* is, for example, provided at a rear end of the movable body 14. The male screw 14*b* is a part screwed to the female screw 15*b* of the female screw member 15. The male screw 14*b* constitutes a screwing portion T together with the female screw 15*b*.

Figure 5A:
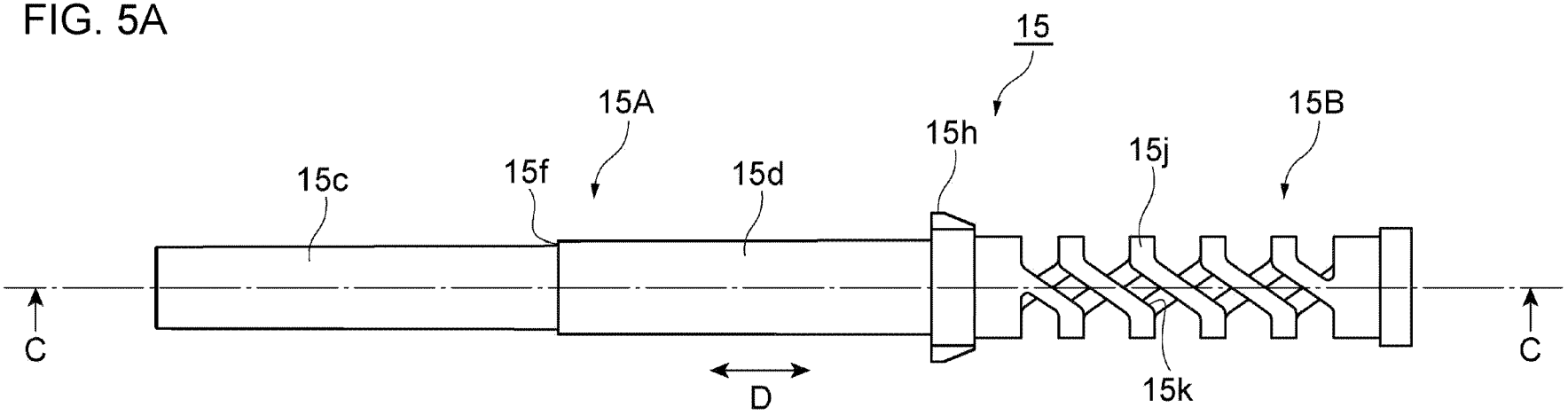
FIG. 5A is a side view illustrating a female screw member according to the embodiment.
Figure 5B:
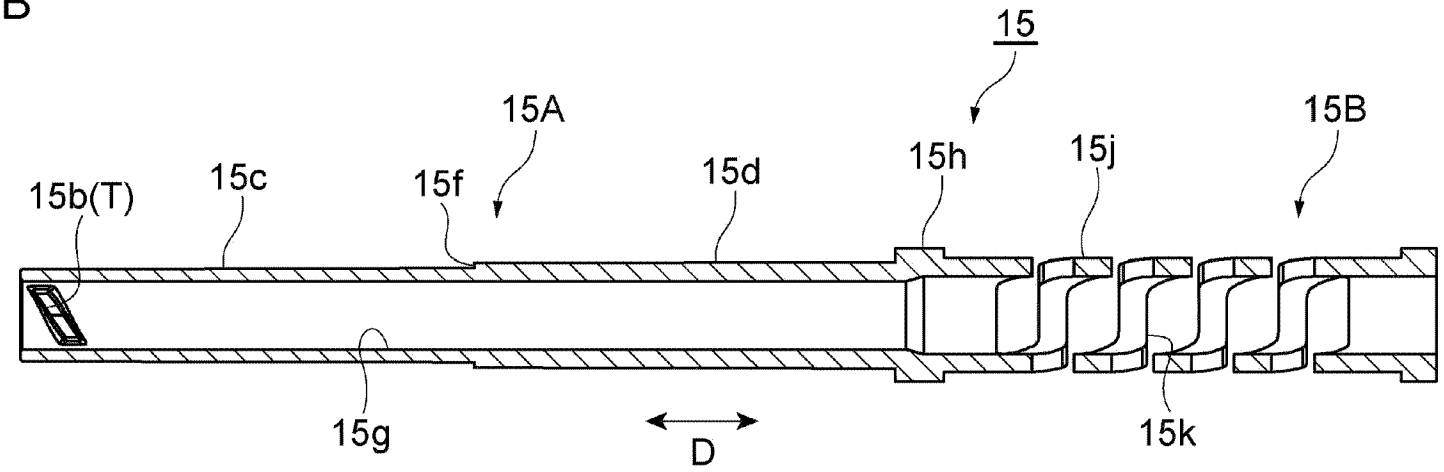
FIG. 5B is a sectional view taken along line C-C of FIG. 5A.

FIG. 5A is a side view illustrating the female screw member 15. FIG. 5B is a sectional view taken along line C-C of FIG. 5A. As illustrated in FIG. 1B, FIG. 5A, and FIG. 5B, the female screw member 15 has a tubular shape extending in the axial direction D. The female screw member 15 includes a tubular portion 15A and a spring portion 15B located on the rear side of the tubular portion 15A.

The tubular portion 15A includes a small-diameter portion 15*c* located on a front side and a large-diameter portion 15*d* located on a rear side. A step 15*f* is formed between the small-diameter portion 15*c* and the large-diameter portion 15*d*. The female screw member 15 has the female screw 15*b* in the inner surface of the small-diameter portion 15*c*. The inside of the female screw member 15 is a housing space 15*g* that houses the rod-shaped portion 14B of the movable body 14.

The female screw member 15 has a protruding portion 15*h* between the tubular portion 15A and the spring portion 15B. The protruding portion 15*h* protrudes outward in the radial direction of the female screw member 15. The protruding portion 15*h* engages with the inner surface of the tubular member 16 in the rotational direction. The protruding portion 15*h* is engaged with the inner surface of the tubular member 16 in the rotational direction, so that the female screw member 15 is engaged with the tubular member 16 in synchronously rotatable manner.

The spring portion 15B extends rearward from the protruding portion 15*h*. The spring portion 15B includes a tubular portion 15*j* and a slit 15*k* formed in the tubular portion 15*j*. The slit 15*k* is in a helical shape extending in the axial direction D in the tubular portion 15*j*. The spring portion 15B with the slit 15*k* alleviates an impact transmitted internally at a time of the action of an external force such as a time of falling of the rod-shaped object feeding container 1 or the like, and thus protects the rod-shaped object feeding container 1 and the rod-shaped cosmetic material M.

Figure 6A:
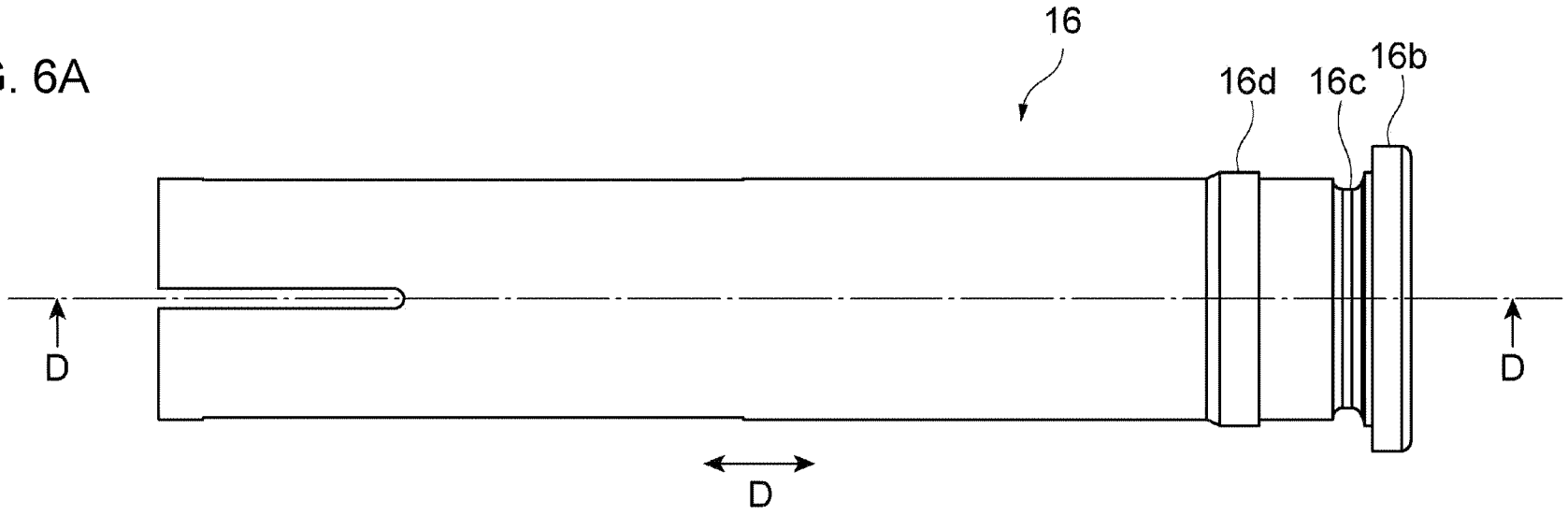
FIG. 6A is a side view illustrating a tubular member according to the embodiment.
Figure 6B:
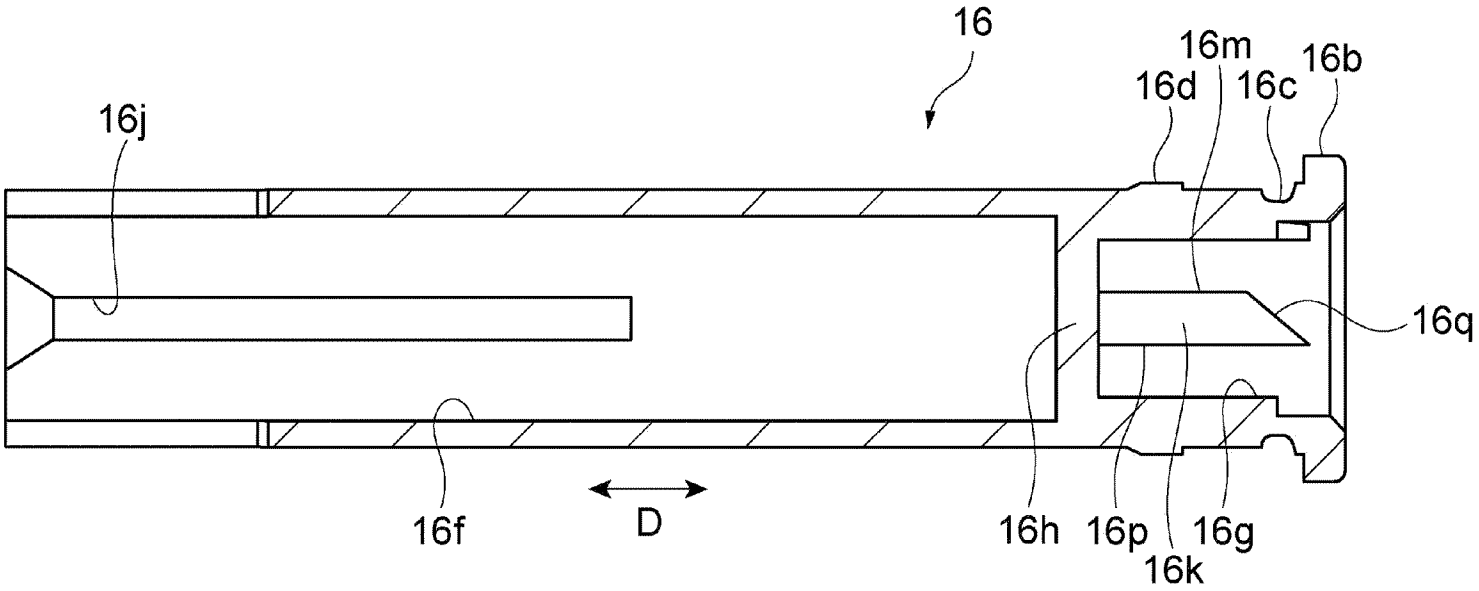
FIG. 6B is a sectional view taken along line D-D of FIG. 6A.

As illustrated in FIG. 1B, FIG. 6A, and FIG. 6B, the tubular member 16 is provided on the rear side of the female screw member 15. The tubular member 16 has a cylindrical shape. The tubular member 16 has a flange portion 16*b* at a rear end of the tubular member 16. The flange portion 16*b* protrudes outward in the radial direction of the tubular member 16. A rear end 12*x* of the leading tube 12 abuts against the flange portion 16*b*.

The tubular member 16 has an annular recessed portion 16*c* located on the front side of the flange portion 16*b* and an annular protruding portion 16*d* located on the front side of the annular recessed portion 16*c*. An O-ring 17 that comes into close contact with the inner surface of the leading tube 12 is inserted into the annular recessed portion 16*c*. The airtightness of the leading tube 12 is ensured by the close contact of the O-ring 17 inserted in the annular recessed portion 16*c* with the inner surface of the leading tube 12. The annular protruding portion 16*d* goes forward over the annular protruding portion 12*w* of the leading tube 12, and engages with the annular recessed portion 12*v*. The annular protruding portion 16*d* is engaged with the annular recessed portion 12*v*, so that the tubular member 16 is engaged with the leading tube 12 in the axial direction D.

The tubular member 16 includes a first internal space 16*f* into which the female screw member 15 is inserted and a second internal space 16*g* into which a coupling member 24 of the knock mechanism unit 20 to be described later is inserted. The second internal space 16*g* is located in the rear of the first internal space 16*f*. The tubular member 16 includes a wall portion 16*h* that separates the first internal space 16*f* from the second internal space 16*g*.

A recessed portion 16*j* into which the protruding portion 15*h* of the female screw member 15 is inserted is formed in the first internal space 16*f*. The recessed portion 16*j* penetrates the tubular member 16 in the radial direction of the tubular member 16, and extends along the axial direction D. The protruding portion 15*h* is inserted into the recessed portion 16*j* extending in the axial direction D, so that the female screw member 15 is engaged with the tubular member 16 in a synchronously rotatable manner.

A first rib 16*k* is formed in the second internal space 16*g*. The first rib 16*k* engages with the coupling member 24 in the rotational direction when the coupling member 24 is inserted in the second internal space 16*g*. The first rib 16*k* extends in the axial direction D. The first rib 16*k* has a first extending surface 16*m* extending in the axial direction D, a second extending surface 16*p* extending in the axial direction D and extending rearward of the first extending surface 16*m*, and an inclined surface 16*q* extending from a rear end of the first extending surface 16*m* to a rear end of the second extending surface 16*p*. The inclined surface 16*q* is inclined with respect to the axial direction D.

The knock mechanism unit 20 according to the present embodiment will next be described. In addition to the knock member 21, the rotary member 22, the main body tube 23, and the coupling member 24 described above, the knock mechanism unit 20 further includes a ratchet member 25 and a spring member 26. The coupling member 24, the ratchet member 25, and the spring member 26 are housed in the main body tube 23.

Figure 7A:
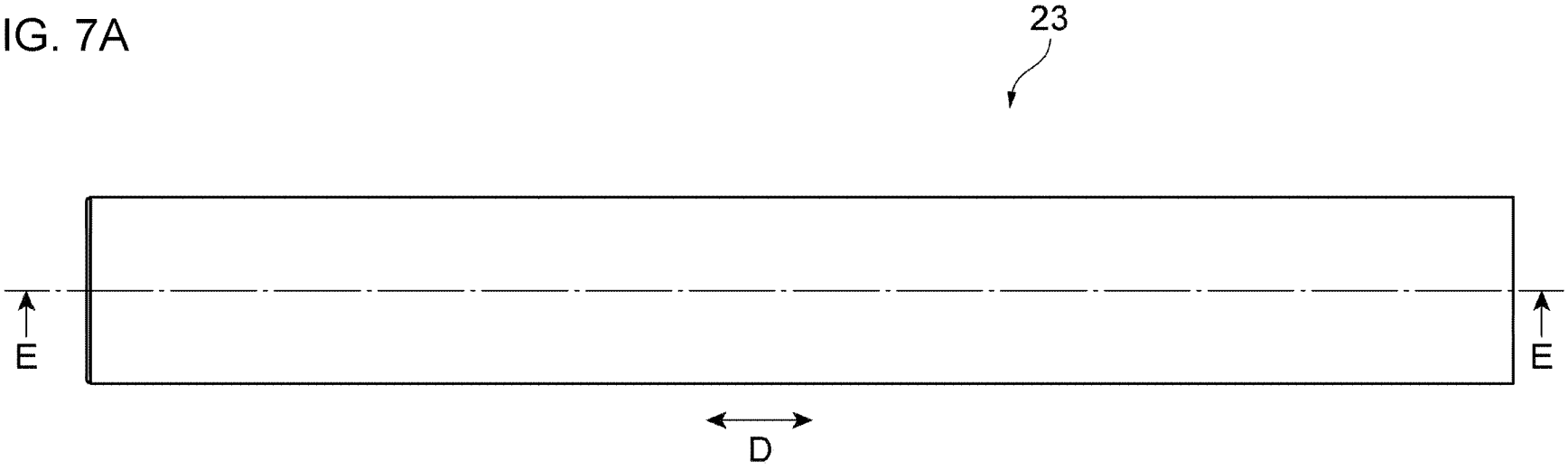
FIG. 7A is a side view illustrating a main body tube according to the embodiment.
Figure 7B:
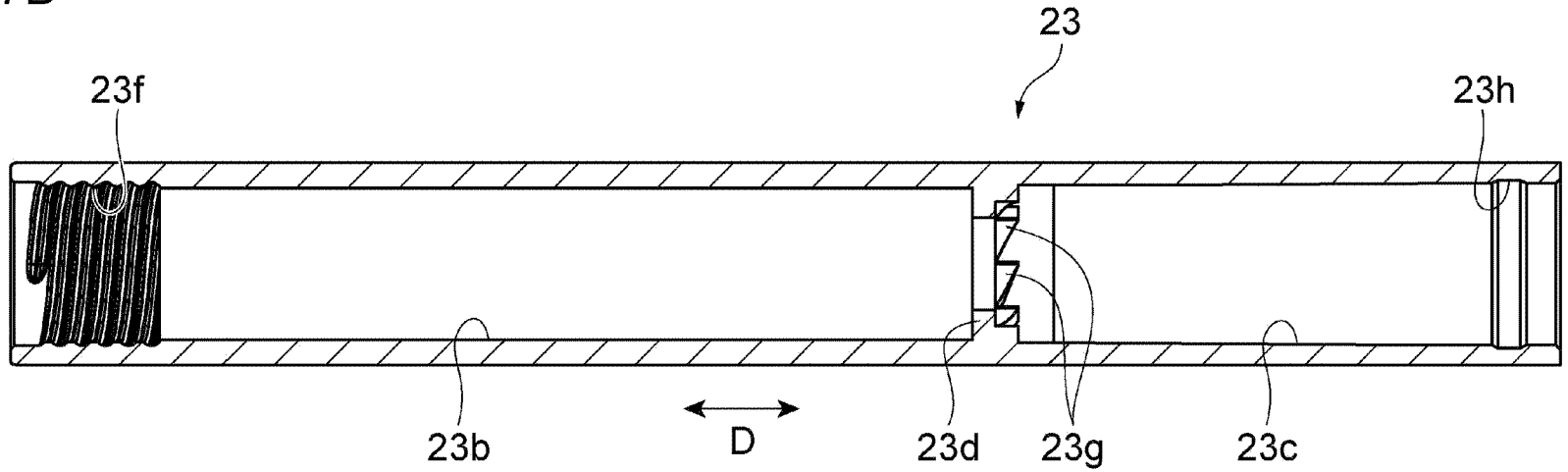
FIG. 7B is a sectional view taken along line E-E of FIG. 7A.

As illustrated in FIG. 1B, FIG. 7A, and FIG. 7B, the main body tube 23 has a cylindrical shape whose external surface is a smoothed surface. That is, the main body tube 23 does not have unevenness on the external surface. The main body tube 23 includes a front side internal space 23*b*, a rear side internal space 23*c*, and a wall portion 23*d* that separates the front side internal space 23*b* from the rear side internal space 23*c*.

The main body tube 23 has a female screw portion 23*f* formed in the front side internal space 23*b*. The male screw portion 12*c* of the leading tube 12 is screwed to the female screw portion 23*f*. The leading tube 12 is attached to the main body tube 23 by screwing the male screw portion 12*c* to the female screw portion 23*f*. The leading tube 12 is attached to the main body tube 23, so that the cartridge unit 10 is attached to the knock mechanism unit 20.

The main body tube 23 has, on the rear side of the wall portion 23*d*, a plurality of inclined protrusions 23*g* arranged along the rotational direction of the main body tube 23. The inclined protrusions 23*g* are parts that engage with the ratchet member 25 in the rotational direction. An annular recessed portion 23*h* is formed in the rear side internal space 23*c*. The annular recessed portion 23*h* is a part with which the ratchet member 25 engages in the axial direction D.

Figure 8A:
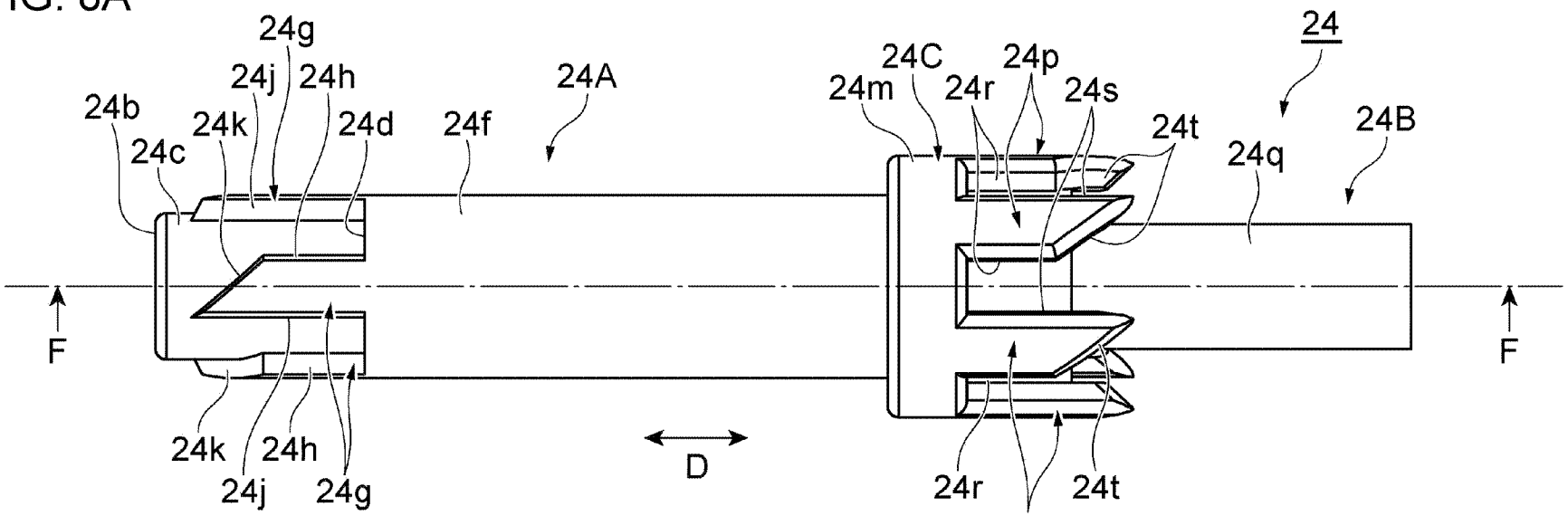
FIG. 8A is a side view illustrating a coupling member according to the embodiment.
Figure 8B:
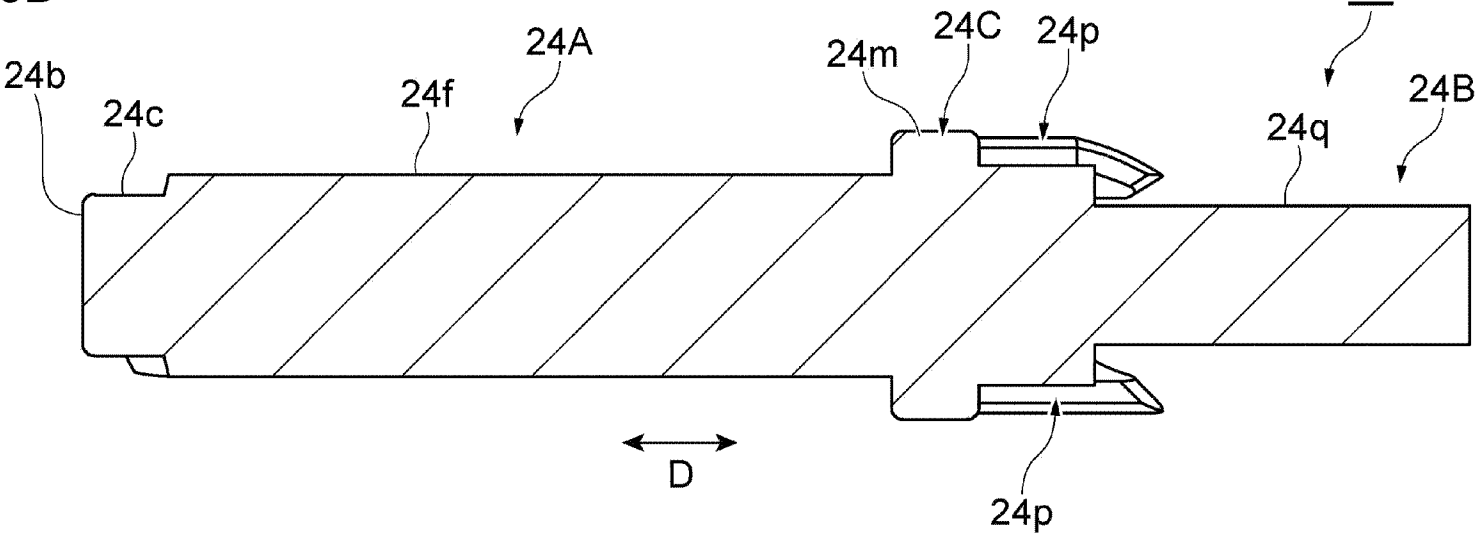
FIG. 8B is a sectional view taken along line F-F of FIG. 8A.

As illustrated in FIG. 1B, FIG. 8A, and FIG. 8B, the coupling member 24 has a rod shape. The coupling member 24 moves in the axial direction D with respect to the main body tube 23. The coupling member 24 engages with the cartridge unit 10 (tubular member 16) in the rotational direction by moving forward (advancing) with respect to the main body tube 23, and separates from the cartridge unit 10 by moving rearward (retracting) with respect to the main body tube 23.

The coupling member 24 includes a front side part 24A, a rear side part 24B, and an enlarged diameter portion 24C located between the front side part 24A and the rear side part 24B. The enlarged diameter portion 24C includes a flange portion 24*m* having an outside diameter larger than the front side part 24A and the rear side part 24B. The front side part 24A has a first outer peripheral surface 24*c* extending rearward from a front end 24*b* of the coupling member 24 and a second outer peripheral surface 24*f* extending rearward from a stepped portion 24*d* located at a rear end of the first outer peripheral surface 24*c*. The rear side part 24B has an outer peripheral surface 24*q* extending rearward from the flange portion 24*m*. The outside diameter of the rear side part 24B is, for example, smaller than the outside diameter of the front side part 24A.

The coupling member 24 has a second rib 24*g* that engages with the first rib 16*k* of the tubular member 16 in the rotational direction. The second rib 24*g* protrudes from the first outer peripheral surface 24*c* and extends in the axial direction D. The height of the second rib 24*g* with respect to the first outer peripheral surface 24*c* is, for example, the same as the height of the second outer peripheral surface 24*f* with respect to the first outer peripheral surface 24*c*. In this case, the second rib 24*g* is flush with the second outer peripheral surface 24*f*.

The second rib 24*g* has a third extending surface 24*h* extending in the axial direction D, a fourth extending surface 24*j* extending in the axial direction D and extending forward of the third extending surface 24*h*, and an inclined surface 24*k* extending from a front end of the third extending surface 24*h* to a front end of the fourth extending surface 24*j*. The inclined surface 24*k* is inclined with respect to the axial direction D. The coupling member 24 has a plurality of second ribs 24*g*, the tubular member 16 has a plurality of first ribs 16*k*, and each of the plurality of second ribs 24*g* enters between a pair of first ribs 16*k* arranged in the rotational direction. The coupling member 24 thereby engages with the tubular member 16 in a synchronously rotatable manner.

The enlarged diameter portion 24C includes the flange portion 24*m* protruding outward in the radial direction of the coupling member 24 from the front side part 24A, and a third rib 24*p* extending rearward from the flange portion 24*m*. The coupling member 24 has a plurality of third ribs 24*p*. The plurality of third ribs 24*p* are arranged along the rotational direction of the coupling member 24. The third ribs 24*p* protrude outward in the radial direction of the coupling member 24 from the outer peripheral surface 24*q* of the rear side part 24B.

The third ribs 24*p* each have a fifth extending surface 24*r* extending rearward from the flange portion 24*m*, a sixth extending surface 24*s* extending rearward from the flange portion 24*m* and extending rearward of a rear end of the fifth extending surface 24*r*, and an inclined surface 24*t* extending from the rear end of the fifth extending surface 24*r* to a rear end of the sixth extending surface 24*s*.

The orientation of the inclined surfaces 24*t* of the third ribs 24*p* is opposite from the orientation of the inclined surfaces 24*k* of the second ribs 24*g*. The knock member 21 moving forward abuts against the inclined surfaces 24*t*. The knock member 21 abuts against the inclined surfaces 24*t*, so that the coupling member 24 is rotated relative to the knock member 21. The third ribs 24*p* engage with the ratchet member 25, which is located radially outward of the coupling member 24, in a synchronously rotatable manner.

Figure 9A:
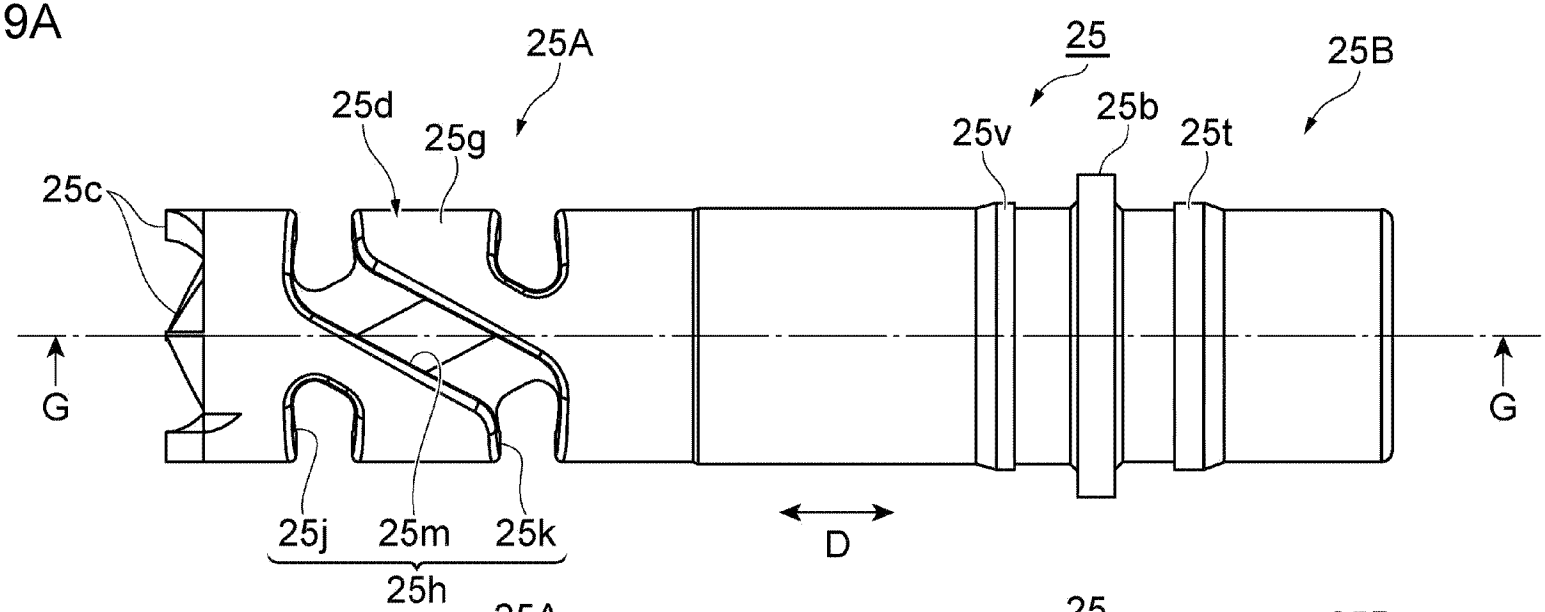
FIG. 9A is a side view illustrating a ratchet member according to the embodiment.
Figure 9B:
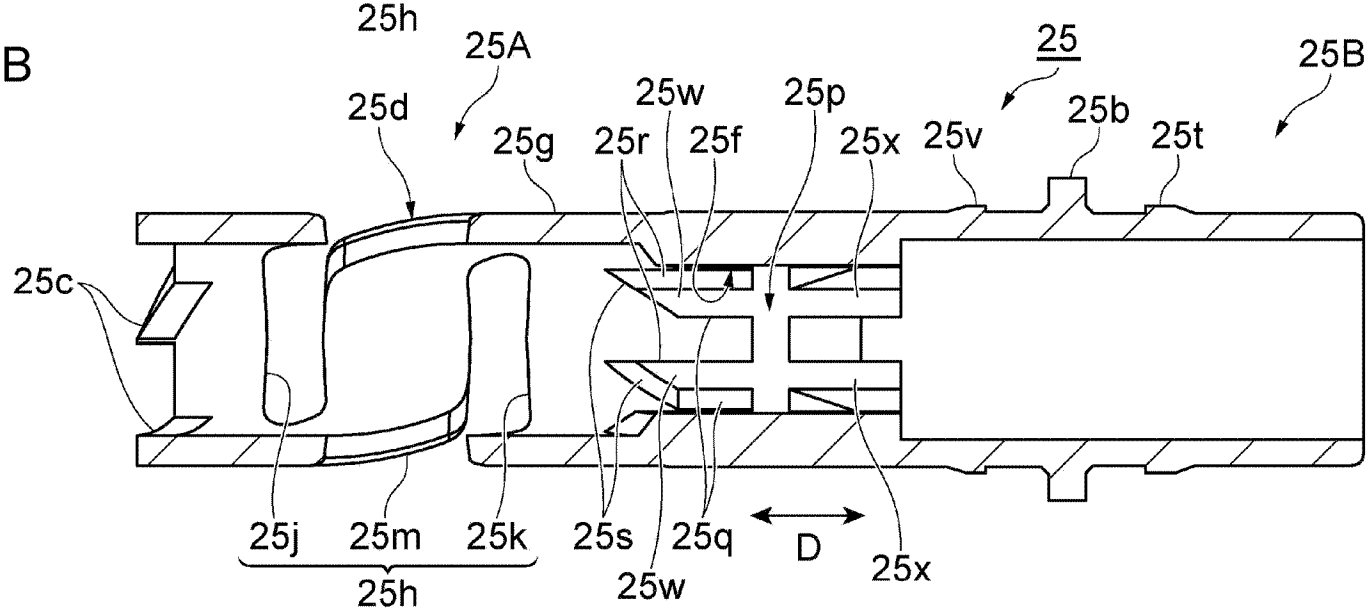
FIG. 9B is a sectional view taken along line G-G of FIG. 9A.

As illustrated in FIG. 1B, FIG. 9A, and FIG. 9B, the ratchet member 25 has a tubular shape. The ratchet member 25 includes a front side tubular portion 25A and a rear side tubular portion 25B. A flange portion 25*b* is formed between the front side tubular portion 25A and the rear side tubular portion 25B. The main body tube 23 faces the front side of the flange portion 25*b*. The rotary member 22 faces the rear side of the flange portion 25*b*. A surface of the flange portion 25*b* facing outward in the radial direction is exposed to the outside of the rod-shaped object feeding container 1. The rear side tubular portion 25B has an annular protruding portion 25*t* that protrudes outward in the radial direction. The rotary member 22 engages with the annular protruding portion 25*t* in the axial direction D.

The front side tubular portion 25A includes inclined protrusions 25*c* located at a front end of the ratchet member 25, a spring portion 25*d* located in the rear of the inclined protrusions 25*c*, and a ratchet portion 25*f* located in the rear of the spring portion 25*d*. The inclined protrusions 25*c* are parts that engage with the inclined protrusions 23*g* of the main body tube 23 in the rotational direction.

The spring portion 25*d* includes a tubular portion 25*g* and a slit 25*h* formed in the tubular portion 25*g*. The slit 25*h* includes a first slit portion 25*j* that extends in the rotational direction of the ratchet member 25, a second slit portion 25*k* that is located in the rear of the first slit portion 25*j* and that extends in the rotational direction of the ratchet member 25, and an inclined slit portion 25*m* that extends from the first slit portion 25*j* to the second slit portion 25*k* and that obliquely extends with respect to the axial direction D. The spring portion 25*d* with the slit 25*h* allows the inclined protrusions 25*c* and the inclined protrusions 23*g* of the main body tube 23 to be rotated in a certain direction (for example, a counterclockwise direction as viewed from the rear).

The ratchet portion 25*f* includes a fourth rib 25*p* formed on the inner surface of the ratchet member 25. The ratchet member 25 includes a plurality of fourth ribs 25*p*. The plurality of fourth ribs 25*p* are arranged along the rotational direction of the ratchet member 25. The fourth ribs 25*p* protrude inward in the radial direction of the ratchet member 25 from the inner surface of the ratchet member 25.

The fourth ribs 25*p* each have a seventh extending surface 25*q* extending in the axial direction D, an eighth extending surface 25*r* extending in the axial direction D and extending forward of a front end of the seventh extending surface 25*q*, and an inclined surface 25*s* extending from the front end of the seventh extending surface 25*q* to a front end of the eighth extending surface 25*r*. The fourth ribs 25*p* engage with the third ribs 24*p* of the coupling member 24 in a synchronously rotatable manner.

The fourth ribs 25*p* each include a front side rib portion 25*w* and a rear side rib portion 25*x*. The front side rib portions 25*w* and the rear side rib portions 25*x* are parts with which the knock member 21 engages in the rotational direction. That is, the front side rib portions 25*w* and the rear side rib portions 25*x* prevent the knock member 21 from rotating. A protruding portion 21*g* to be described later of the knock member 21 in a state of not being pressed engages with the front side rib portions 25*w* in the rotational direction. A tapered portion 21*d* to be described later of the knock member 21 in a state of being pressed engages with the rear side rib portions 25*x* in the rotational direction. The knock member 21 thus engages with the fourth ribs 25*p* in the rotational direction.

The front side tubular portion 25A has an annular protruding portion 25*v* that protrudes outward in the radial direction of the ratchet member 25. The annular protruding portion 25*v* is provided on the front side of the flange portion 25*b*. The annular recessed portion 23*h* of the main body tube 23 engages with the annular protruding portion 25*v*. The annular recessed portion 23*h* is engaged with the annular protruding portion 25*v*, so that the main body tube 23 is engaged with the ratchet member 25 in the axial direction D.

Figure 10A:
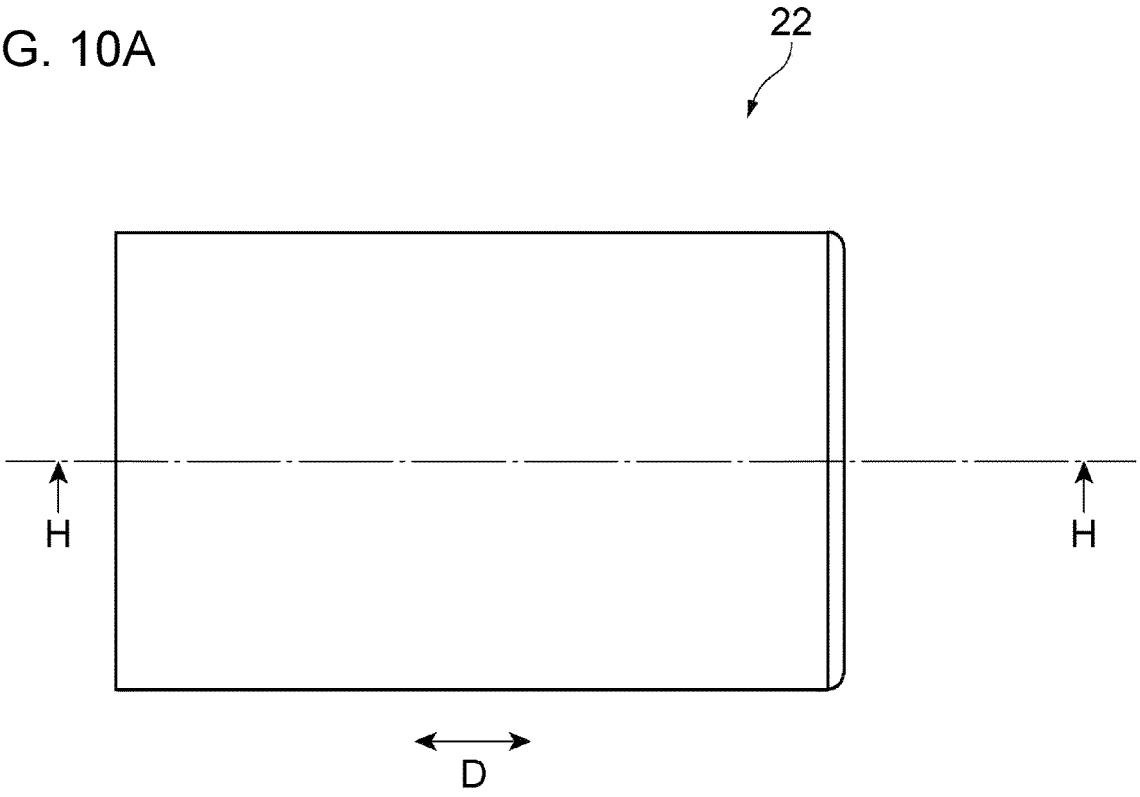
FIG. 10A is a side view illustrating a rotary member according to the embodiment.
Figure 10B:
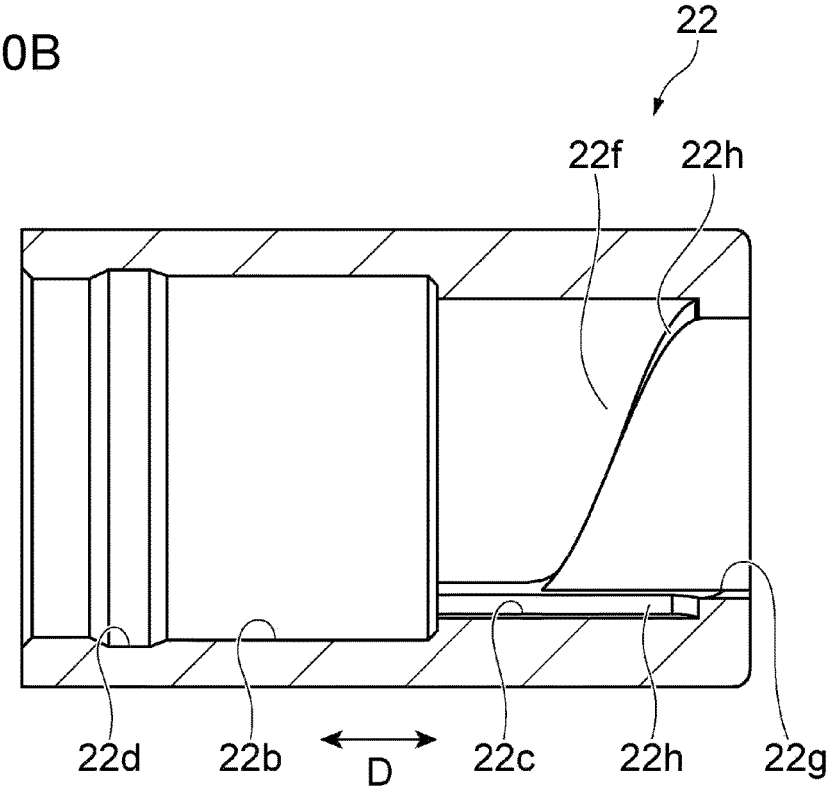
FIG. 10B is a sectional view taken along line H-H of FIG. 10A.

As illustrated in FIG. 1B, FIG. 10A, and FIG. 10B, the rotary member 22 has a cylindrical shape whose external surface is a smoothed surface. The rotary member 22 houses the rear side tubular portion 25B of the ratchet member 25 and the knock member 21. The inside of the rotary member 22 is provided with a front side housing portion 22*b* and a rear side housing portion 22*c* having an inside diameter smaller than the front side housing portion 22*b*. The front side housing portion 22*b* houses the rear side tubular portion 25B, and the rear side housing portion 22*c* houses the knock member 21.

An annular recessed portion 22*d* recessed outward in the radial direction of the rotary member 22 is formed in the front side housing portion 22*b*. The annular protruding portion 25*t* of the ratchet member 25 engages with the annular recessed portion 22*d*. The annular protruding portion 25*t* is engaged with the annular recessed portion 22*d*, so that the ratchet member 25 is engaged with the rotary member 22 in the axial direction D.

A helical recessed portion 22*f* is formed in the rear side housing portion 22*c*. The helical recessed portion 22*f* is a step that is recessed outward in the radial direction of the rotary member 22 from an inner surface 22*g* extending from a rear end of the rotary member 22. Further, the helical recessed portion 22*f* is a part extending forward from a helical wall 22*h*. The rotary member 22, for example, has two helical walls 22*h*.

The helical walls 22*h* defining the helical recessed portions 22*f* are in a helical shape. The helical walls 22*h* are helical wall portions located at rear ends of the helical recessed portions 22*f*. The helical walls 22*h* are parts which protruding portions 21*b* to be described later of the knock member 21 face. When the protruding portions 21*b* move along the helical walls 22*h*, the rotary member 22 moves helically with respect to the knock member 21.

Figure 11A:
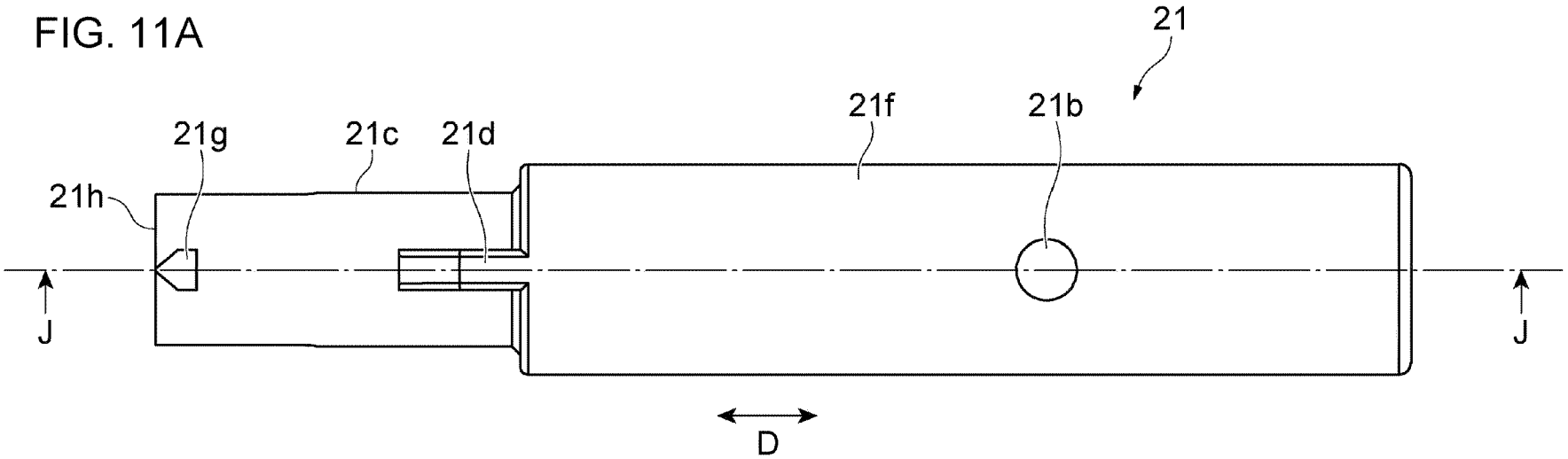
FIG. 11A is a side view illustrating a knock member according to the embodiment.
Figure 11B:
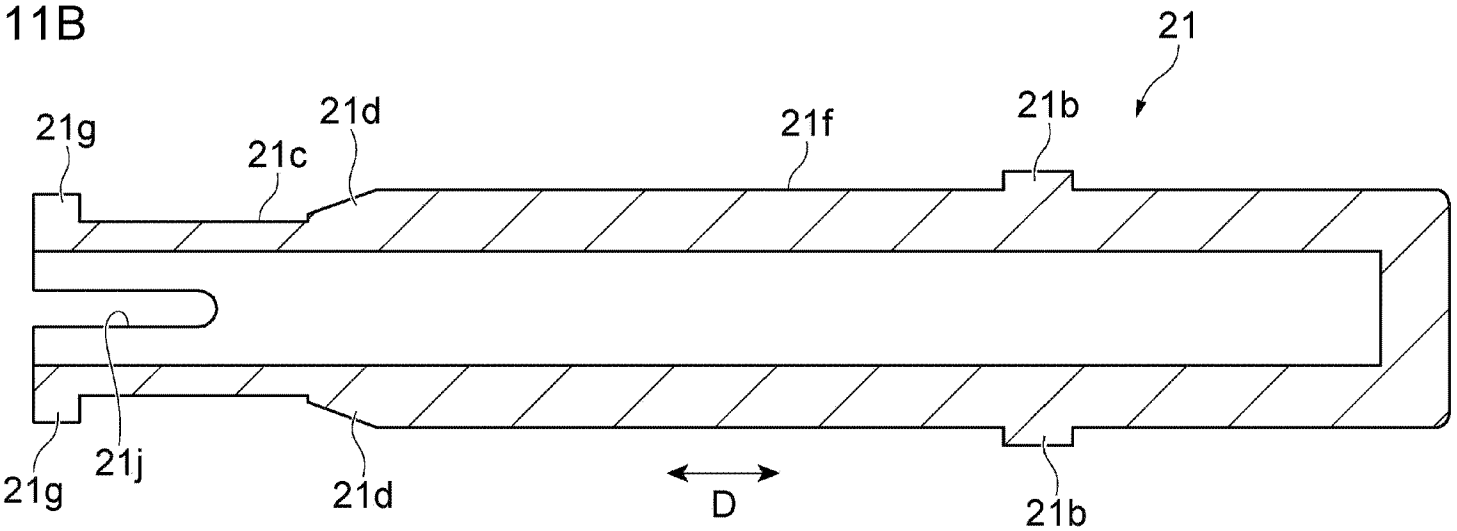
FIG. 11B is a sectional view taken along line J-J of FIG. 11A.

As illustrated in FIG. 1B, FIG. 11A, and FIG. 11B, the knock member 21 has a bottomed tubular shape. The knock member 21 can be pressed to feed the rod-shaped cosmetic material M. The knock member 21 can be pressed forward. The rod-shaped cosmetic material M is fed by pressing the knock member 21 forward. The knock member 21 includes a small-diameter portion 21*c* located on a front side, the tapered portion 21*d* gradually increased in diameter from a rear end of the small-diameter portion 21*c*, and a large-diameter portion 21*f* extending rearward from the tapered portion 21*d*. The knock member 21 has a plurality of tapered portions 21*d*. The plurality of tapered portions 21*d* are arranged along the rotational direction of the knock member 21.

The knock member 21 has the protruding portion 21*g* on the small-diameter portion 21*c*. The knock member 21 has a plurality of protruding portions 21*g*. The plurality of protruding portions 21*g* are arranged along the rotational direction of the knock member 21. The protruding portions 21*g* are arranged on an imaginary straight line passing through the tapered portions 21*d* and extending along the axial direction D. That is, the positions of the protruding portions 21*g* in the rotational direction of the knock member 21 are the same as the positions of the tapered portions 21*d* in the rotational direction of the knock member 21.

The protruding portions 21*g* engage with the front side rib portions 25*w* of the fourth ribs 25*p* of the ratchet member 25 in the rotational direction. The knock member 21 has a slit 21*j* extending rearward from a front end 21*h* of the knock member 21. The tapered portions 21*d* of the knock member 21 engage with the rear side rib portions 25*x* of the fourth ribs 25*p* of the ratchet member 25 in the rotational direction. The knock member 21, for example, has two protruding portions 21*b*. The protruding portions 21*b* each have a cylindrical shape. The protruding portions 21*b* helically move along the helical walls 22*h* of the rotary member 22.

The knock mechanism unit 20 includes a spring member 26. The spring member 26 is disposed between the wall portion 23*d* of the main body tube 23 and the flange portion 24*m* of the coupling member 24. A front end of the spring member 26 is located at the wall portion 23*d*. A rear end of the spring member 26 is located at the flange portion 24*m*. The spring member 26 biases the coupling member 24 and the knock member 21 rearward.

Description will be made of procedures for feeding (advancing) the rod-shaped cosmetic material M and returning (retracting) the rod-shaped cosmetic material M in the rod-shaped object feeding container 1 configured as described above. First, in an initial state (unused state), the coupling member 24 of the knock mechanism unit 20 is not engaged with the tubular member 16 of the cartridge unit 10 in the rotational direction. That is, the second ribs 24*g* are not engaged with the first ribs 16*k* in the rotational direction. At this time, the cartridge unit 10 is replaceable from the knock mechanism unit 20 by removing the leading tube 12 from the main body tube 23.

Figure 12A:
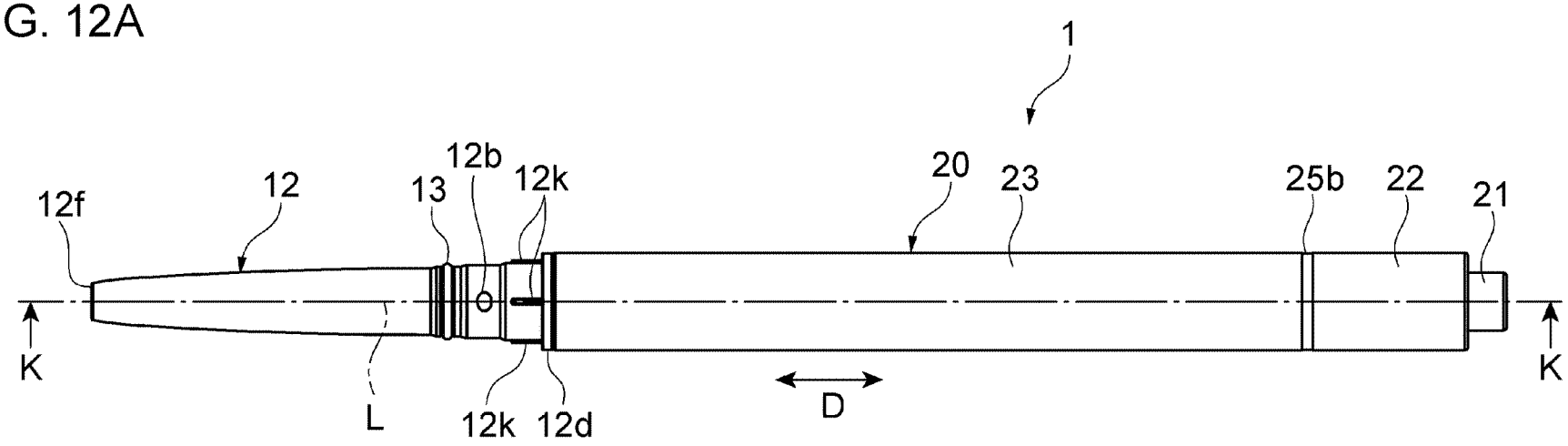
FIG. 12A is a side view illustrating a state at a time of feeding a rod-shaped object of the rod-shaped object feeding container.
Figure 12B:
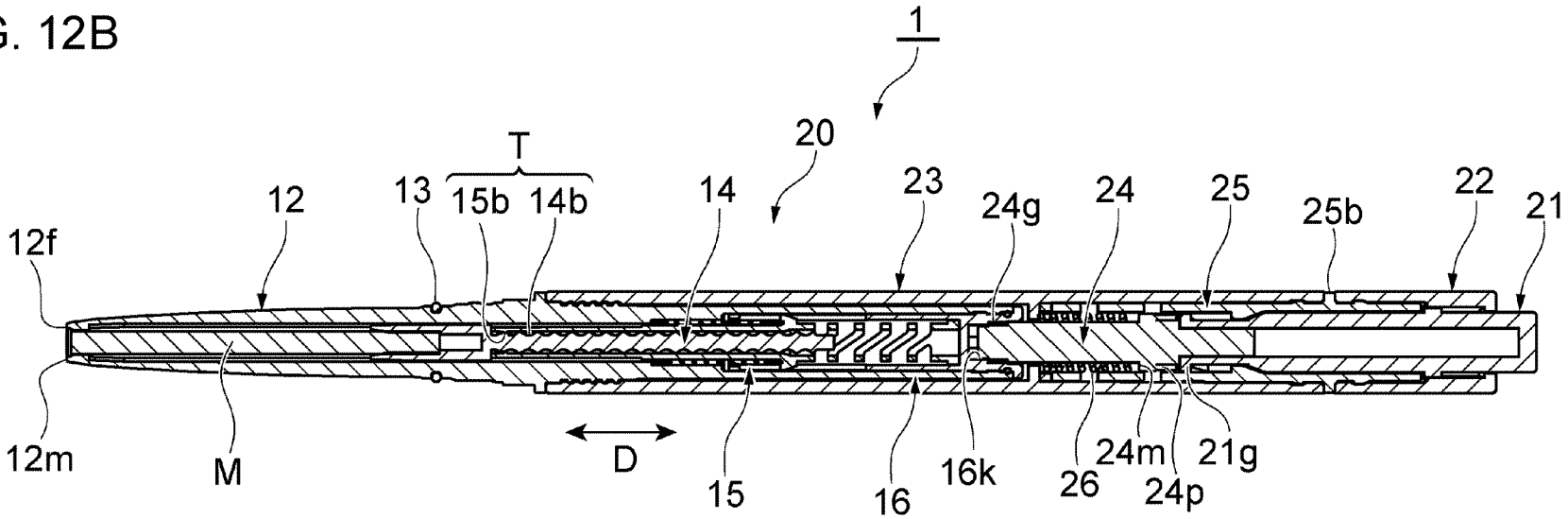
FIG. 12B is a sectional view taken along line K-K of FIG. 12A.

When the rod-shaped cosmetic material M is to be fed, as illustrated in FIG. 1B, FIG. 12A, and FIG. 12B, the cap 11 is removed from the rod-shaped object feeding container 1, and the leading tube 12 is exposed. When the knock member 21 is pressed forward, the coupling member 24 advances and engages with the tubular member 16 in the rotational direction, and the protruding portions 21*g* come into contact with the inclined surfaces 24*t* (see FIG. 8A) of the coupling member 24.

At this time, the protruding portions 21*g* come into contact with the inclined surfaces 24*t* in a state in which the second ribs 24*g* are engaged with the first ribs 16*k* in the rotational direction. The inclined surfaces 24*t* move in the rotational direction with respect to the advancing protruding portions 21*g*. The coupling member 24 and the tubular member 16 are therefore rotated relative to the knock member 21 in one direction (for example, a clockwise direction as viewed from the rear).

When the coupling member 24 and the tubular member 16 are rotated in the one direction, the tubular member 16 and the female screw member 15 are synchronously rotated, and the female screw member 15 is rotated relative to the movable body 14 in the one direction. With the relative rotation in the one direction, the screwing action of the screwing portion T including the female screw 15*b* and the male screw 14*b* is exerted, and the screwing action advances the movable body 14. Then, the movable body 14 and the rod-shaped cosmetic material M advance with respect to the leading tube 12, so that the rod-shaped cosmetic material M is fed from the opening 12*m* of the leading tube 12.

An amount of feeding of the rod-shaped cosmetic material M in one time of knocking (pressing) of the knock member 21 is 0.5 mm, for example. When the pressing of the knock member 21 is released, the coupling member 24 and the knock member 21 are moved rearward by a biasing force of the spring member 26, and the coupling member 24 is separated from the tubular member 16. Then, the positions of the coupling member 24 and the knock member 21 are returned to the positions in the initial state.

Figure 13A:
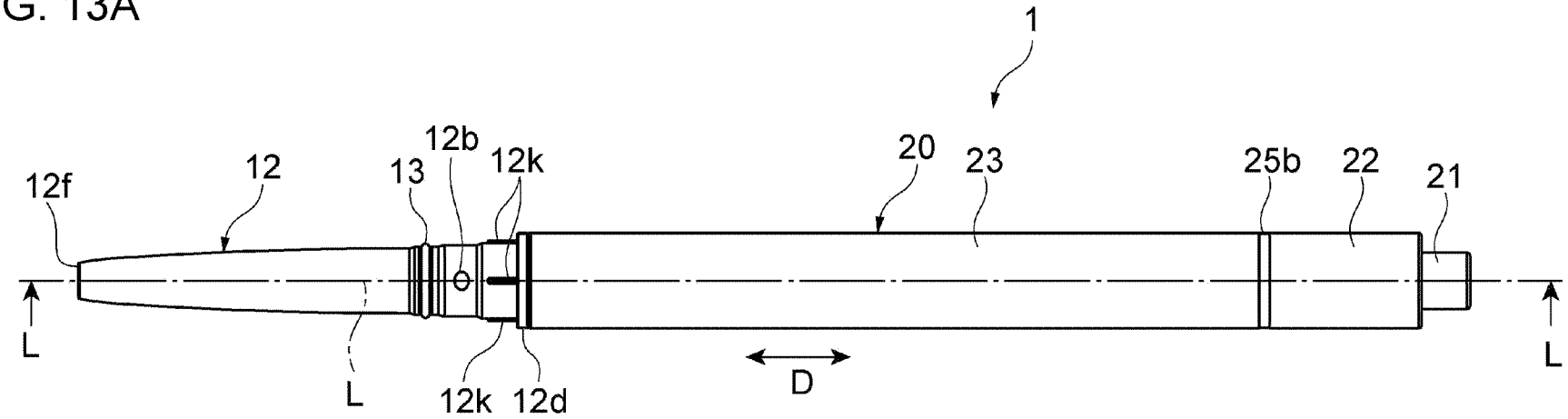
FIG. 13A is a side view illustrating a state at a time of returning the rod-shaped object of the rod-shaped object feeding container.
Figure 13B:
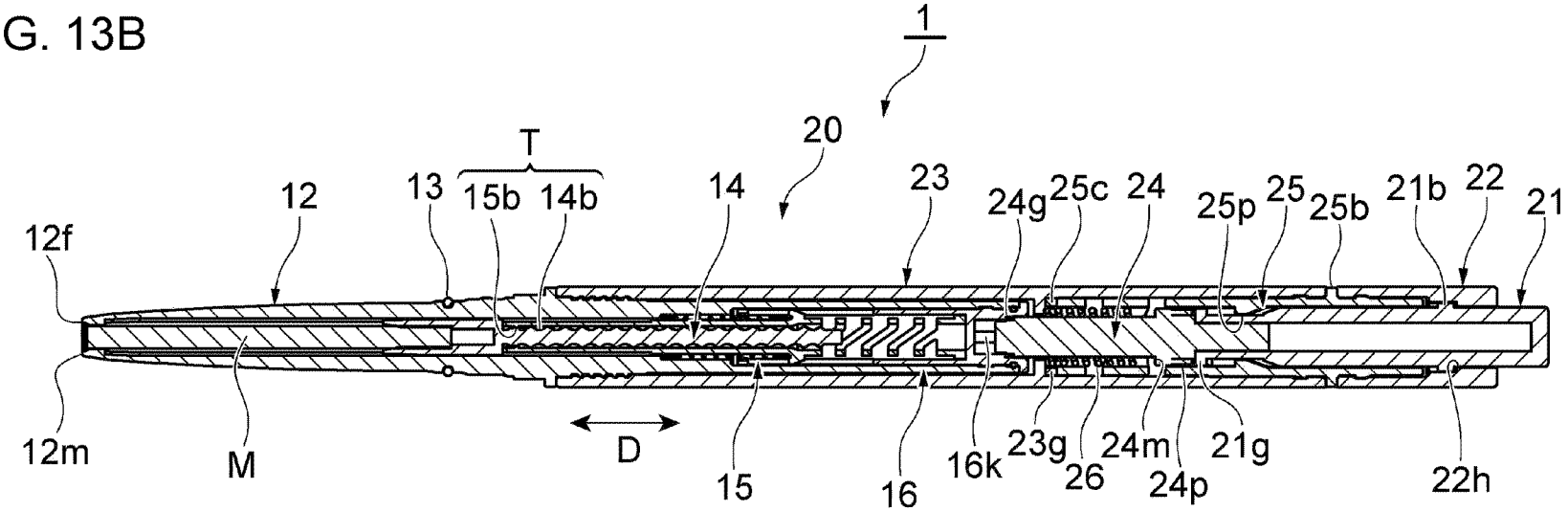
FIG. 13B is a sectional view taken along line L-L of FIG. 13A.

When the rod-shaped cosmetic material M is to be returned, as illustrated in FIG. 1B, FIG. 13A, and FIG. 13B, the rotary member 22 is rotated relative to the main body tube 23 in an opposite direction from the above-described one direction (for example, a counterclockwise direction as viewed from the rear). When the rotary member 22 is rotated relative to the main body tube 23 in the opposite direction, the protruding portions 21*b* of the knock member 21 advance along the helical walls 22*h* of the rotary member 22.

At this time, the fourth ribs 25*p* of the ratchet member 25 engage with the third ribs 24*p* of the coupling member 24 in the rotational direction. Further, when the rotary member 22 is rotated relative to the main body tube 23 in the opposite direction, the rotary member 22, the knock member 21, the ratchet member 25, and the coupling member 24 are synchronously rotated. At this time, because the ratchet member 25 is rotated relative to the main body tube 23, the inclined protrusions 25*c* of the ratchet member 25 go over the inclined protrusions 23*g* of the main body tube 23 in the opposite direction, thereby producing a ticking click sound.

Accordingly, the coupling member 24, the tubular member 16, and the female screw member 15 are synchronously rotated, and the coupling member 24, the tubular member 16, and the female screw member 15 are rotated relative to the movable body 14 in the opposite direction. With the relative rotation in the opposite direction, the screwing action of the screwing portion T is exerted, and the screwing action retracts the movable body 14. The movable body 14 and the rod-shaped cosmetic material M retract with respect to the leading tube 12, so that the rod-shaped cosmetic material M is returned.

Next, operational effects of the rod-shaped object feeding container 1 according to the present embodiment will be described in detail. The rod-shaped object feeding container 1 includes the cartridge unit 10 having the rod-shaped cosmetic material M, and the knock mechanism unit 20 attachable to and detachable from the cartridge unit 10. Therefore, after the rod-shaped cosmetic material M is used up, it suffices to detach (or remove) the cartridge unit 10 from the knock mechanism unit 20 and discard only the cartridge unit 10. Hence, it is not necessary to discard the entire rod-shaped object feeding container 1, and it suffices to attach (or fit) a new cartridge unit 10 to the existing knock mechanism unit 20 at a time of replacement of the cartridge unit 10. The number of discarded parts can therefore be reduced.

The knock mechanism unit 20 includes the coupling member 24 synchronously rotatable with the female screw member 15 of the cartridge unit 10, the knock member 21 advancing the rod-shaped cosmetic material M, and the rotary member 22 housing the knock member 21. When the knock member 21 is pressed, the knock member 21 converts a force with which the knock member 21 is pressed into a rotational force and causes the coupling member 24 and the female screw member 15 to be rotated relative to the movable body 14 in the one direction. The knock member 21 thereby advances the movable body 14 and the rod-shaped cosmetic material M. Therefore, because the pressing of the knock member 21 can advance the rod-shaped cosmetic material M to be fed, the usability of the rod-shaped object feeding container 1 can be improved. That is, a highly usable rod-shaped object feeding container 1 can be provided because the rod-shaped cosmetic material M can be fed by holding the rod-shaped object feeding container 1 with one hand and pressing the knock member 21 with one hand.

In addition, when the pressing to the knock member 21 is released and the rotary member 22 is rotated relative to the main body tube 23 in the opposite direction from the above-described one direction, the rotary member 22 causes the coupling member 24 and the female screw member 15 to be rotated relative to the movable body 14 in the opposite direction. The rotary member 22 thereby retracts the movable body 14 and the rod-shaped cosmetic material M. The rod-shaped cosmetic material M can therefore be retracted by the relative rotation of the rotary member 22 with respect to the main body tube 23. Thus, the rod-shaped object feeding container 1 allows the rod-shaped cosmetic material M to be fed by a knock and allows the rod-shaped cosmetic material M to be returned by the rotation of the rotary member 22.

In the present embodiment, the cartridge unit 10 includes the tubular member 16 located on the rear side of the female screw member 15. The tubular member 16 is synchronously rotatable with the female screw member 15 and is configured to be coupled with the coupling member 24. The tubular member 16 had the first ribs 16*k* formed on the inner surface thereof. The first ribs 16*k* extend along the axial direction D in which the axis of the tubular member 16 extends. The coupling member 24 has the second ribs 24*g* formed on the external surface thereof. The second ribs 24*g* are configured to engage with the first ribs 16*k* in the rotational direction. Hence, the female screw member 15 of the cartridge unit 10 and the coupling member 24 of the knock mechanism unit 20 can be coupled to each other via the tubular member 16, and the female screw member 15, the tubular member 16, and the coupling member 24 can be made synchronously rotatable.

In the present embodiment, the knock mechanism unit 20 includes the ratchet member 25 in a tubular shape disposed in the main body tube 23. The ratchet member 25 houses the coupling member 24. As illustrated in FIGS. 8A and 8B and FIGS. 9A and 9B, the coupling member 24 has the third ribs 24*p* formed on the external surface thereof. The third ribs 24*p* extend along the axial direction D in which the axis of the ratchet member 25 extends. The ratchet member 25 has the fourth ribs 25*p* formed on the inner surface thereof. The fourth ribs 25*p* are configured to engage with the third ribs 24*p* in the rotational direction when the coupling member 24 and the female screw member 15 are rotated relative to the movable body 14 in the opposite direction. Hence, the ratchet member 25 can be synchronously rotated together with the coupling member 24 and the female screw member 15 in the opposite direction.

An embodiment of the rod-shaped object feeding container according to the present disclosure has been described above. However, the rod-shaped object feeding container according to the present disclosure is not limited to the foregoing embodiment, but may be modified within the scope of the gist described in each claim, and further used in another object. That is, the configuration, shape, size, material, and arrangement mode of each part constituting the rod-shaped object feeding container can be changed as appropriate within the scope of the above-described gist.

For example, in the foregoing embodiment, description has been made of an example in which the rod-shaped object is the rod-shaped cosmetic material M having volatility. However, in the present disclosure, the rod-shaped object may be a rod-shaped cosmetic material not having volatility, or may be a rod-shaped object other than a cosmetic material. The rod-shaped object according to the present disclosure may be a cosmetic material such as a lip gloss, a lipstick, an eyeshadow, or an eyeliner, as described above, may be stationery (drawing material) such as a marking pen, medication, or may be a rod-shaped object containing a slurry substance. These rod-shaped objects can also be applied to the rod-shaped object feeding container according to the present disclosure.

What is claimed is:

1. A rod-shaped object feeding container comprising:

a cartridge unit that has a rod-shaped object, the cartridge unit including:

a movable body that has a gripping portion configured to grip the rod-shaped object and has a male screw at an outer peripheral portion thereof, and a tubular female screw member that has a female screw configured to be screwed to the male screw; and a knock mechanism unit which the cartridge unit is attachable to and detachable from and which advances and retracts the rod-shaped object, the knock mechanism unit including:

a coupling member that is configured to be coupled to the cartridge unit and is synchronously rotatable with the female screw member when coupled to the cartridge unit, a knock member capable of being pressed to advance the rod-shaped object, a spring member that is configured to bias the coupling member and the knock member rearward, a main body tube that houses the coupling member and the spring member, and a rotary member that is disposed on a rear side of the main body tube, houses the knock member, and is rotatable relative to the main body tube, wherein when the knock member is pressed, the knock member converts a force with which the knock member is pressed into a rotational force and causes the coupling member and the female screw member to be rotated relative to the movable body in one direction so as to advance the movable body and the rod-shaped object, and wherein when pressing of the knock member is released and the rotary member is rotated relative to the main body tube in an opposite direction from the one direction, the rotary member causes the coupling member and the female screw member to be rotated relative to the movable body in the opposite direction, so as to retract the movable body and the rod-shaped object.

2. The rod-shaped object feeding container according to claim 1, wherein the cartridge unit includes a tubular member that is located on a rear side of the female screw member, is synchronously rotatable with the female screw member, and is configured to be coupled with the coupling member, wherein the tubular member has a first rib formed on an inner surface thereof and the first rib extends along an axial direction in which an axis of the tubular member extends, and wherein the coupling member has a second rib formed on an external surface thereof and the second rib is configured to engage with the first rib in a rotational direction.

3. The rod-shaped object feeding container according to claim 2, wherein the knock mechanism unit includes a tubular ratchet member that is disposed in the main body tube and houses the coupling member, wherein the coupling member has a third rib formed on an external surface thereof and the third rib extends along an axial direction in which an axis of the ratchet member extends, and wherein the ratchet member has a fourth rib formed on an inner surface thereof and the fourth rib is configured to engage with the third rib in the rotational direction when the coupling member and the female screw member are rotated relative to the movable body in the opposite direction.

4. The rod-shaped object feeding container according to claim 1, wherein the knock mechanism unit includes a tubular ratchet member that is disposed in the main body tube and houses the coupling member, wherein the coupling member has a third rib formed on an external surface thereof and the third rib extends along an axial direction in which an axis of the ratchet member extends, and wherein the ratchet member has a fourth rib formed on an inner surface thereof and the fourth rib is configured to engage with the third rib in a rotational direction when the coupling member and the female screw member are rotated relative to the movable body in the opposite direction.

5. The rod-shaped object feeding container according to claim 4, wherein the cartridge unit includes a leading tube, a cap attachable to and detachable from the leading tube, and a tubular member located on a rear side of the female screw member, wherein the leading tube has a first annular recessed portion formed on an external surface thereof, and a first O-ring that is inserted into the first annular recessed portion is configured to be in close contact with an inner surface of the cap, and wherein the tubular member has a second annular recessed portion formed on an external surface thereof, and a second O-ring that is inserted into the second annular recessed portion is in close contact with an inner surface of the leading tube.

6. The rod-shaped object feeding container according to claim 1, wherein the cartridge unit includes a leading tube, a cap attachable to and detachable from the leading tube, and a tubular member located on a rear side of the female screw member, wherein the leading tube has a first annular recessed portion formed on an external surface thereof, and a first O-ring that is inserted into the first annular recessed portion is configured to be in close contact with an inner surface of the cap, and wherein the tubular member has a second annular recessed portion formed on an external surface thereof, and a second O-ring that is inserted into the second annular recessed portion is in close contact with an inner surface of the leading tube.

* * * * *